US007473296B2

(12) United States Patent
Takayama et al.

(10) Patent No.: US 7,473,296 B2
(45) **Date of Patent: *Jan. 6, 2009**

(54) WEAR-RESISTANT SINTERED CONTACT MATERIAL, WEAR-RESISTANT SINTERED COMPOSITE CONTACT COMPONENT AND METHOD OF PRODUCING THE SAME

(75) Inventors: Takemori Takayama, Hirakata (JP); Kazuo Okamura, Kameoka (JP); Yoshikiyo Tanaka, Hirakata (JP); Tetsuo Ohnishi, Yawata (JP)

(73) Assignee: Komatsu, Ltd. (JP)

( * ) Notice: Subject to any disclaimer, the term of this patent is extended or adjusted under 35 U.S.C. 154(b) by 525 days.

This patent is subject to a terminal disclaimer.

(21) Appl. No.: 11/217,440

(22) Filed: Sep. 2, 2005

(65) Prior Publication Data

US 2006/0002811 A1 Jan. 5, 2006

Related U.S. Application Data

(62) Division of application No. 10/745,981, filed on Dec. 29, 2003, now Pat. No. 7,094,473.

(30) Foreign Application Priority Data

Dec. 27, 2002 (JP) ..... 2002-380203

(51) Int. Cl.
*B22F 3/00* (2006.01)
*B22F 7/04* (2006.01)

(52) U.S. Cl. ..... 75/246; 75/231; 75/243; 419/11; 419/25; 419/30; 419/60

(58) Field of Classification Search ..... 75/236, 75/243, 246; 428/545; 419/11, 25, 30, 58, 419/60

See application file for complete search history.

(56) References Cited

U.S. PATENT DOCUMENTS

| | | | | |
|---|---|---|---|---|
| 2,462,821 | A * | 2/1949 | Wellman | 427/183 |
| 4,388,114 | A | 6/1983 | Suganuma et al. | |
| 4,524,046 | A * | 6/1985 | Suganuma et al. | 419/8 |
| 4,596,692 | A * | 6/1986 | Morishita et al. | 419/7 |
| 4,873,150 | A | 10/1989 | Doi et al. | |
| 4,969,262 | A * | 11/1990 | Hiraoka et al. | 29/888.1 |
| 5,466,276 | A | 11/1995 | Sato et al. | |
| 5,591,023 | A | 1/1997 | Nakamura et al. | |
| 5,674,449 | A | 10/1997 | Liang et al. | |
| 5,753,005 | A | 5/1998 | Aoki et al. | |
| 7,018,107 | B2 | 3/2006 | Beswick et al. | |
| 2003/0209103 | A1 | 11/2003 | Takayama | |
| 2004/0035499 | A1 | 2/2004 | Takayama | |
| 2004/0047757 | A1 | 3/2004 | Takayama | |

FOREIGN PATENT DOCUMENTS

| | | | |
|---|---|---|---|
| JP | 61-006202 | A | 1/1986 |
| JP | 61-119604 | A | 6/1986 |
| JP | 62-112707 | A | 5/1987 |
| JP | 63-158320 | A | 7/1988 |
| JP | 63-230850 | A | 9/1988 |
| JP | 01-275742 | A | 11/1989 |
| JP | 02-085338 | A | 3/1990 |
| JP | 02-093042 | A | 4/1990 |
| JP | 02-185903 | A | 7/1990 |
| JP | 02-203081 | A | 8/1990 |
| JP | 02-140931 | U | 11/1990 |
| JP | 02-140931 | U | 11/1990 |
| JP | 02-290905 | A | 11/1990 |
| JP | 03-061349 | A | 3/1991 |
| JP | 03-158443 | A | 7/1991 |
| JP | 03-183744 | A | 9/1991 |
| JP | 03-219050 | A | 9/1991 |
| JP | 03-219057 | A | 9/1991 |
| JP | 04-056751 | A | 2/1992 |
| JP | 04-191343 | A | 7/1992 |
| JP | 04-254556 | A | 9/1992 |
| JP | 04-300469 | A | 10/1992 |
| JP | 09-049006 | A | 2/1997 |
| JP | 10-219410 | A | 8/1998 |
| JP | 10-330805 | A | 12/1998 |
| JP | 11-172305 | A | 6/1999 |
| JP | 11-217637 | A | 8/1999 |
| JP | 11-269508 | A | 10/1999 |
| JP | 11-293304 | A | 10/1999 |
| JP | 11-293305 | A | 10/1999 |

(Continued)

*Primary Examiner*—Roy King
*Assistant Examiner*—Ngoclan T Mai
(74) *Attorney, Agent, or Firm*—Rader Fishman & Grauer PLLC; Ronald P. Kananen

(57) ABSTRACT

A wear-resistant iron-based sintered contact material is provided which is sintered by powder sintering so as to have high density, high seizure resistance and wear resistance. A wear-resistant iron-based sintered composite contact component composed of the wear-resistant iron-based sintered contact material sinter-bonded to a backing metal and its producing method are also provided. To this end, at least $Cr_7C_3$-type carbide and/or $M_6C$-type carbide which have an average particle diameter of 5 μm or more are precipitately dispersed in an amount of 20 to 50% by volume within an iron-based martensite parent phase which has a hardness of HRC 50 or more even when tempered at up to 600° C.

4 Claims, 10 Drawing Sheets

FOREIGN PATENT DOCUMENTS

| | | | |
|---|---|---|---|
| JP | 2000-063912 | A | 2/2000 |
| JP | 2001-107109 | A | 4/2001 |
| JP | 2002-180216 | A | 6/2002 |
| JP | 2003-89831 | | 3/2003 |
| JP | 2003-328078 | | 11/2003 |
| JP | 2004-76125 | | 3/2004 |
| SU | 1687643 | A1 | 10/1991 |
| WO | WO-84/04760 | A1 | 12/1984 |

* cited by examiner 4 (a)

4 (b)

5(a)

5(b)

7(a)

8 ( a )

8 ( b )

WEAR-RESISTANT SINTERED CONTACT MATERIAL, WEAR-RESISTANT SINTERED COMPOSITE CONTACT COMPONENT AND METHOD OF PRODUCING THE SAME

This application is a divisional application of U.S. patent application Ser. No. 10/745,981 filed Dec. 29, 2003 now U.S. Pat. No. 7,094,473, the entire content being incorporated by reference.

TECHNICAL FIELD

The present invention relates to a wear-resistant sintered contact material that is applied to a sealing material or the like for use in rotating parts of construction machines etc. with a view to achieving improved seizure resistance and preventing abnormal wear to attain increased wear life, particularly when used under a badly-lubricated sliding contact condition such as high surface pressure, low speed and high speed. The present invention also relates to a high-performance, wear-resistant sintered composite contact component and a producing method thereof. The wear-resistant sintered composite contact component is composed of the above wear-resistant sintered contact material sinter-bonded to a backing metal and is applicable to floating seals used for encapsulation of lubricating oil, thrust washers for use in the joint of a work implement, and the end faces of a crawler track bushing in a chassis.

BACKGROUND ART

A floating seal incorporated in a track roller assembly of a construction machine is used for the purpose of preventing penetration of earth and sand. It has therefore good corrosion resistance and often produced from hard, high-carbon, high-Cr cast iron which is improved in seizure resistance and wear resistance by crystallization of a large amount (30% by volume or more) of $Cr_7C_3$ carbide having high hardness. The contact surface of a floating seal that is required to slide under a higher speed condition is coated with cemented carbide composed of WC and self-fluxing alloy by thermal spraying.

Wear-resistant contact materials such as thrust washers used for the end faces of work implement bushings, which are required to slide without seizing under a higher surface pressure, lower speed, grease-lubricated condition and to have wear resistance and load resistance as important factors, are usually made from carburized or induction-hardened steel. For reducing greasing frequency to meet the demand for easy maintenance, the following measure is sometimes taken in recent years. Specifically, in the joint of a work implement of a construction machine for example, an oil-bearing bushing formed by impregnating a work implement bushing with lubricating oil is used and a thrust washer is disposed on the end faces of the bushing, which thrust washer is formed from steel that is coated with a seizure-resistant, wear-resistant cemented carbide composed of WC/self-fluxing alloy by thermal spraying.

As a prior art technique associated with the present invention, a method of adding alloy elements to effectively enhance the temper softening resistance of a martensite parent phase has been proposed by us in Japanese Patent Application Nos. 2002-135274 and 2002-240967.

The above-described floating seal for hermetically sealing a track roller assembly to confine lubricating oil has revealed the problem that since fine earth/sand particles creep onto the sealing surface owing to their rubbing motion within the floating seal mechanism while wear is progressing and the sealing surface is lubricated with the confined lubricating oil, the lubricating condition is extremely severe, so that as the setting pressure (i.e., pressing force) under which the floating seal is assembled increases, seizure, quenching cracks and abnormal wear are more likely to occur on the sliding contact surface, which results in oil leakage.

The latest construction machines such as bulldozers are required to have improved work efficiency during high speed traveling, and therefore, the floating seal has to rotate at high speed, which results in seizure, quenching cracks and abnormal wear accompanied with oil leakage as described above.

While there is a demand for a cost reduction by increasing the service life of the track roller assembly and others, the current wear-resistant cast steel materials cannot exert wear resistance good enough to meet the demand.

Further, the thermal-spray-coated thrust washer for use in a bearing part of a work implement suffers from the problem that biting of penetrating earth and sand causes damage to the washer.

Although it has been contemplated that the cold tool steel (SKD material), high speed steel (SKH material) and the like may be applied as a material for improving the seizure resistance and wear resistance of a floating seal and a thrust washer, such tool steels do not necessarily have satisfactory seizure resistance and wear resistance. Moreover, such tool steels are costly and therefore the costs of material and machining work are too high when taking account of the yield of the material consumed to obtain a finished product.

The present invention is directed to overcoming the foregoing problems and a primary object of the invention is therefore to provide a wear-resistant iron-based sintered contact material that is produced by powder sintering so as to have high density, high seizure resistance and wear resistance. Another object of the invention is to provide a low-strain, wear-resistant, iron-based sintered composite contact component and a producing method thereof, the component being formed such that instability in the accuracy of configuration/dimension caused by compaction during a sintering process is avoided by sinter-bonding the material of the above wear-resistant iron-based sintered contact material to a backing metal during a sintering process in the production of the wear-resistant iron-based sintered contact material.

DISCLOSURE OF THE INVENTION

The floating seal made from high-carbon high-Cr cast iron has a composition near the eutectic composition (carbon content=about 3.4 wt %) of the Fe—C—Cr phase diagram and is formed such that $Cr_7C_3$ carbide is crystallized as a primary crystal (having a rod-like shape and a diameter of 2 to 3 μm), and then an eutectic structure composed of fine rod-like $Cr_7C_3$ carbide (having a diameter of about 0.3 μm) and an austenite phase (becomes a martensite phase after cooling) is formed so that the total amount of the hard $Cr_7C_3$ carbide is 30 to 40% by volume. This floating seal however has the following intrinsic problem. Since the rod-like $Cr_7C_3$ carbide is likely to align in parallel with the direction of cooling at the time of coagulation whereas the brittle cleavage plane (00•1) of the $Cr_7C_3$ carbide is likely to be oriented in parallel with the sliding contact surface of the floating seal, the fine eutectic carbide ($Cr_7C_3$) is easily crushed by an adhesive force locally generated on the sliding contact surface and this crushed powder causes further adhesion and wear.

In the high-carbon high-Cr based ingot tool steel materials such as SKD1, SKD 2 and SKD 11, although huge carbide ($Cr_7C_3$ type) particles inherent to high alloy steel and fine $Cr_7C_3$-type carbide particles precipitately disperse within a martensite parent phase, they do not have satisfactory seizure resistance and wear resistance because the huge carbide particles unevenly disperse in a large amount and the total amount of the carbides does not exceed 20% by volume. High-speed ingot steel materials having higher hardness such as SKH2, SKH10, SKH54 and SKH57 contain large amounts of $M_6C$-type carbide and MC-type carbide precipitately dispersed within the martensite parent phase, but the total amount of the carbides does not exceed 15% by volume. It is therefore apparent that these materials also suffer from the same problem as the aforesaid high-carbon high-Cr based tool steel does.

Taking the above problems into account, we have developed wear-resistant iron-based sintered contact materials which have excellent wear resistance and high-carbon, high-Cr, high-Mo compositions. According to a first invention, there is provided a wear-resistant iron-based sintered contact material wherein at least $Cr_7C_3$-type and/or $M_6C$-type ($Fe_3Mo_3C$, $Fe_3W_3C$, $Fe_3(Mo, W)_3C$) carbides, which are granular when they are in their sintered state, are dispersed within a martensite parent phase such as seen in the SKD and SKH tool steels, which parent phase has a hardness of 50 or more (HRC) even when tempered at 600° C., and wherein the cleavage plane of the $Cr_7C_3$-type carbide is arranged in a random order with respect to the sliding contact surface, thereby reducing damage to the $Cr_7C_3$ carbide and the total amount of the carbides including the $M_6C$ carbide is increased to 20 to 50% by volume.

Although the MC-type carbide is suitably used as the carbide to be dispersed, the use of the MC-type carbide gives rise to a need for a large amount of alloy elements such as W, V, Ti, Nb and Zr, which spoils the economic efficiency of the wear-resistant sintered contact material. Therefore, in the invention, the precipitative dispersion of the MC-type carbide is restricted to 5% by volume or less.

As the carbide to be dispersed, a high-carbon Fe—Cr alloy fine powder containing a high concentration of the $Cr_7C_3$-type carbide or a high-carbon Fe—Mo alloy fine powder containing a high concentration of the $M_6C$-type carbide may be used, but it is desirable to take a method in which a carbon component added at the time of sintering reacts with Cr and/or Mo and the like, thereby precipitately dispersing a carbide having a composition in equilibrium with the martensite parent phase, because the method can reduce, for instance, the Mo concentration of the $M_6C$ carbide.

The $Cr_7C_3$-type carbide has the following features. The $Cr_7C_3$-type carbide hardly gets damaged because it has a particle size of 3 μm or more that is equal to or larger than the diameter of the aforesaid primary crystal $Cr_7C_3$-type carbide. It has been found from observation of the cross-section of the sliding contact surface of a floating seal (described later) that local adhesion and a drag stress caused by wear concentrate in the area 5 to 8 μm deep from the surface. In view of this, the average particle diameter of the $Cr_7C_3$-type carbide is preferably 5 μm or more. In order to precipitately disperse coarse carbide particles, most (80% by volume or more) of the $Cr_7C_3$ carbide particles are allowed to precipitate in the crystal grain boundaries and grow quickly so that the granular $Cr_7C_3$-type carbide precipitating in a small amount within the grains is surrounded by the large $Cr_7C_3$-type carbide precipitating within the grain boundary, thereby preventing deterioration of seizure resistance and wear resistance.

The reason why the total amount of the carbides is set to 20% by volume or more is that the carbide contents of high-carbon tool steels (e.g., SKD1 and SKD2) containing various ordinary carbides precipitately dispersed therein do not exceed 20% by volume, whereas the invention aims to achieve higher wear resistance and seizure resistance than these tool steels. It is apparent that a more preferable total amount of the carbides is 25% by volume or more. The total amount of the carbides is limited to less than 50% by volume in order to prevent brittleness caused by the structural continuation of the carbides, and a more preferable amount is 45% by volume or less.

It is known that when the high-carbon tool steel is in a quenched state, a large amount of retained austenite phase is often formed which decreases quench hardness. We conducted a preliminary test to check the amount of retained austenite phase (percent by volume) formed in various high-carbon tool steels quenched at different temperatures and the hardness of the quenched tool steels, and found that when the amount of retained austenite phase exceeded 60% by volume, there was likely to arise the problem that a hardness of 50 (HRC) could not be ensured. As obviously understood from this result, it is desirable to limit the amount of retained austenite phase to 60% by volume or less. In doing so, either or both of the following measures are taken: One measure is such that quenching is not carried out at a sintering temperature of 1100° C. or more but carried out after cooling to a quenching temperature of 900 to 1100° C. In another measure, tempering is performed at 250 to 600° C. like the tempering process of high-alloy tool steel to thereby decompose the retained austenite while precipitating alloy carbides.

It is known that when producing a floating seal, thrust washer or the like which wears away while biting earth and sand, there occurs a strain induced martensitic transformation from the retained austenite phase at the sliding contact surface into a martensite phase. It is predicted from the above preliminary test that when the retained austenite phase is formed in an amount of 60% by volume or more in a quenched state, the retained austenite is more stabilized so that the martensitic transformation does not proceed, resulting in poor wear resistance.

It is also well known that, in the case of a floating seal, a strain induced martensitic transformation of the retained austenite phase occurs owing to local adhesion occurring at the sliding contact surface and a stress caused by wear so that the transformed portion is significantly hardened; that the conformability between the seals can be improved by a martensitic transformation, thereby reducing early oil leakage and improving seizure resistance; and that a similar phenomenon can be seen in a tooth gear material which rolls while sliding under a high surface pressure. According to a second invention, there is provided a wear-resistant iron-based sintered contact material wherein 10 to 60% by volume retained austenite phase is formed in the martensite parent phase. A preferable amount of the retained austenite phase is 20 to 60% by volume.

The retained austenite phase is markedly stabilized and produced in large amounts by addition of Mn and Ni. However, since Mn is likely to hamper sinterability, its amount is preferably limited to 2 wt % or less. Positive addition of Ni is preferable when taking account of the fact that Ni significantly concentrates within the martensite parent phase than within the carbides and the coexistence of Ni and Al increases the toughness of the martensite parent phase. However, it is advisable to limit the amount of Ni to 4 wt % or less in view of the fact that excessive Ni addition causes excessive retained austenite, resulting in decreased wear resistance.

The temperature at the center of the collar of a floating seal (see FIG. 5) usually rises up to 100 to 150° C. and thermal cracking is often observed at its sliding contact surface that is about to adhere. It is easily analogized from this that the sliding contact surface is exposed to a temperature as high as 500 to 600° C. If the martensite parent phase of the sintered material is temper-softened by heat generated during sliding, the seizure resistance and wear resistance will obviously significantly decreases in spite of the precipitative dispersion of the hard carbide particles. Therefore, the invention is characterized in that in order to increase the temper softening resistance of the martensite parent phase to a degree equal to or higher than that of SKD-based tool steel, the composition of the martensite parent phase is adjusted such that the hardness of the martensite parent phase can be kept at HRC 50 or more even when the sintered material is tempered at at least 600° C.

Further, the above-noted carbides are allowed to precipitately disperse in an amount of 20 to 50% by volume within the martensite parent phase.

Methods of adding alloy elements in order to effectively increase the temper softening resistance of the martensite parent phase have been disclosed by us in Japanese Patent Application Nos. 2002-240967 and 2002-135274. More specifically, in a steel material containing 0.25 to 0.55 wt % C and 3.5 to 5.5 wt % or more Cr, the temper softening resistance of each alloy element is determined by (temper softening resistance coefficient×the percent by weight of an alloy element) and the temper softening resistance value of all the alloy elements is quantified by the following equation.

$$\text{Temper softening resistance value}=3\times(\text{Si}+\text{Al})\ \text{wt}\ \%+2.8\times\text{Cr}\ \text{wt}\ \%+11\times\text{Mo}\ \text{wt}\ \%+25.7\times\text{V}\ \text{wt}\ \%+7.5\times\text{W}\ \text{wt}\ \%$$

Herein, the temper softening resistance coefficient of each alloy element is defined as an increase in Rockwell hardness for every 1 wt % of an alloy element and the upper limit (wt %) of Mo is equal to the effective amount (1000° C.=2.1 wt %; 1100° C.=3.0 wt %; 1150° C.=4 wt %) dependent on the solubility of Mo carbide. The amount of Mo exceeding the effective amount is used for carbide formation and therefore does not contribute to an improvement in the temper softening resistance.

Where sintering is performed at a sintering temperature of 1100 to 1250° C. followed by quenching like the present invention, the effective amount of Mo in the martensite parent phase is 4 wt % in maximum and is reduced to 2.0 wt % by addition of 4.5 wt % or more Cr as described later. Therefore, it is functionally and economically effective to control the Mo content of the martensite parent phase so as not to exceed 2.0 wt %. In this case, since a large amount of retained austenite is produced, hardening is often done unsatisfactorily in a quenched state, but it is obvious that a harder wear-resistant iron-based sintered contact material can be obtained by a tempering process at a temperature of 450 to 600° C. such as applied to the high-alloy tool steel described earlier.

When quenching is performed after cooling the furnace from the above sintering temperature to a quenching temperature, the amount of the retained austenite phase in a quenched state is restricted, but the effective amount of Mo apparently decreases as the quenching temperature decreases. Where the quenching temperature is 1000° C., the effective amount of Mo in the martensite parent phase is 2.1 wt % in maximum and becomes 1.05 wt % in coexistence with 3.5 wt % or more Cr, resulting in a decrease in the temper softening resistance of the martensite parent phase.

As disclosed in Japanese Patent Application Nos. 2002-240967 and 2002-135274, the temper softening resistance improving function of Cr is dependent on the carbon concentration of the martensite parent phase. It, however, is advisable to take account of the fact that where the carbon concentration of the martensite parent phase at a sintering temperature of 1100° C. is about 0.7 wt %, addition of 4.5 wt % or more Cr reduces the effective amount of Mo to half while reducing the temper softening resistance coefficient of Si, and addition of 7.0 wt % or more Cr reduces the temper softening resistance coefficient of inherence of Cr. Similarly to the case of Mo, where the sintering temperature is 950 to 1000° C. addition of 3.5 wt % or more Cr halves the effective amount of Mo and reduces the temper softening resistance coefficient of Si.

V is an element that most significantly increases the temper softening resistance of the martensite parent phase. The solubility of V in the martensite parent phase is 0.7 wt % or more in the case of the present invention wherein sintering is carried out at 1100 to 1250° C. (See Japanese Patent Application Nos. 2002-240967 and 2002-135274: From the fact that the solubility of V is 0.4 wt % when the sintering temperature is 950° C. and 0.5 wt % when the sintering temperature is 1000° C., it can be presumed that the solubility of V at a sintering temperature of 1100° C. is 0.7 wt %). It is understood from this that the maximum amount of V that is effective for working on the temper softening resistance of the martensite parent phase is 0.7 wt %. It should however be noted that where quenching is carried out after the furnace is cooled from the above sintering temperature to a quenching temperature, the effective amount decreases as the quenching temperature decreases.

If Si contained in the martensite parent phase exceeds 1.7 wt %, the effective amount of V is halved and half the amount (wt %) of Si functions to reduce the effective amount (wt %) of Mo. Therefore, the amount of Si should be taken into account.

In view of the above result as well as the fact that the amount of Cr contained in the martensite parent phase of various tool steels (described later) is 3.5 wt % or more and high Cr provides good corrosion resistance, we have developed a wear-resistant iron-based sintered contact material as a third invention. In the wear-resistant iron-based sintered contact material according to the third invention, a martensite parent phase contains 0.05 to 1.7 wt % Si and 3.5 to 7.0 wt % Cr, contains 0.4 to 2.0 wt % Mo and/or 0.2 to 0.7 wt % V, and further contains an appropriate amount of one or more alloy elements selected from the group consisting of Mn, W, Ni, Co, Cu, Al and the like. In this contact material, 25 to 40% by volume $Cr_7C_3$-type carbide particles are precipitately dispersed within the martensite parent phase. More preferably, the amount of Si is restricted to 0.05 to 1.0 wt % and the amount of Mo which enhances the temper softening resistance falls within the range of from 1.0 to 2.0 wt % and the amount of V which enhances the temper softening resistance falls within the range of from 0.45 to 0.7 wt %.

If the composition of the martensite parent phase and the amount of the carbides to be precipitately dispersed are predetermined like the third invention, the composition of the wear-resistant iron-based sintered contact material is obtained in the following way. The distribution coefficients of the alloy elements such as Cr, Si, Mo, V, W, Ni, Co, Cu, Al, Mn and the like existing between the martensite parent phase having the above composition and the precipitately dispersed $Cr_7C_3$ carbide in equilibrium with the parent phase are surveyed beforehand to calculate the compositions of the carbides, like the examples described later. Then, the composition of the wear-resistant iron-based sintered contact material is calculated from the settings of the amounts of the carbides to be precipitately dispersed and the composition of the martensite parent phase. As a result of such calculation, it is determined that the wear-resistant iron-based sintered contact material of the third invention contains at least 2.5 to 3.7 wt % C, 0.05 to 1.3 wt % Si, and 10 to 18 wt % Cr as indispensable elements, contains either or both of 0.6 to 3.5 wt % Mo and 0.4 to 4.0 wt % V, and further contains one or more elements selected from the group consisting of Mn, Ni, W, Co, Cu and Al. More preferably, the amount of Si is 0.05 to 0.8 wt %, the amount of Mo is 1.5 to 3.5 wt % and the amount of V is 1.5 to 4.0 wt %. Among these elements, V considerably concentrates in the $Cr_7C_3$-type carbide, being thermodynamically stabilized so that it functions to reduce the amount of carbon soluble in the parent phase and increase the temper hardness of the martensite parent phase to a considerable extent. Thus, V is suitably employed in the wear-resistant iron-based sintered contact material applied to the above-described floating seal because it increases the thermal cracking resistance, seizure resistance and wear resistance of the sliding contact surface.

Generally, the temper hardness of a conventional tool steel (described later) is obtained through the process in which the steel is once softened at a temperature in the vicinity of 300 to 400° C. and then hardened again at 450° C. or more (secondary hardening) by making use of the action of the elements such as Mo, V, W and the like. Where a tool steel used for forming a floating seal or thrust washer is produced, it is preferable that softening in the vicinity of 300 to 400° C. be minimized to obtain a temper hardness of HRC 50 or more at up to 600° C. and the high-alloy tool steel tempering process noted earlier be carried out. However, such a tempering process is costly, and it is therefore preferable to effectively utilize Si and Al to a full extent, Si and Al being inexpensive and functioning to markedly increase the temper softening resistance in the low temperature region of 400° C. or less. In this case, the parent phase contains 2.0 to 4.5 wt % Cr, 0.05 to 1.7 wt % Si and 1 to 4.0 wt % Mo. Further, V may be positively added up to 0.2 to 0.7 wt %. It is apparently desirable in view of economical efficiency to add 0.8 to 1.7 wt % Si and 1 to 3.6 wt % Mo. In the above case, it is preferable that alloy elements such as W, Ni, Co, Cu, Al, Mn and the like be added in appropriate amounts thereby increasing the temper softening resistance and ensuring hardenability. There has been developed a wear-resistant iron-based sintered contact material as a fourth invention in which 20 to 40% by volume $Cr_7C_3$-type carbide particles are precipitately dispersed in the martensite parent phase.

According to the fourth invention, the temper softening resistance which enables a temper hardness (HRC) of 50 or more at 600° C. is calculated with the following equation.

$$\text{Temper softening resistance value } 21.2 \leqq 5.8\times(\text{Si}+\text{Al}) \text{ wt } \% + 2.8\times\text{Cr wt } \% + 11\times\text{Mo wt } \% + 25.7\times\text{V wt } \% + 7.5\times\text{W wt } \%$$

The Cr concentration, which satisfies the above equation where the lower limit of Si is 0.8 wt % and the lower limit of Mo is 1 wt %, is about 2 wt %. In view of economical efficiency, the concentration of Cr preferably falls within the range of from 2.0 to less than 4.5 wt % in the fourth invention, because the Cr concentration of the parent phase of SKD4 and SKD5 is 2 wt % and little importance is given to corrosion resistance.

Similarly to the calculation of the composition of the wear-resistant iron-based sintered contact material in the third invention, the composition of the wear-resistant iron-based sintered contact material of the fourth invention was calculated. As a result, the wear-resistant iron-based sintered contact material of the fourth invention at least contains 2.5 to 3.7 wt % C, 0.05 to 1.3 wt % Si, and 8 to 13.5 wt % Cr as indispensable elements, contains either or both of 2.0 to 6.5 wt % Mo and 0.4 to 4.0 wt % V, and further contains one or more elements selected from the group consisting of Mn, Ni, W, Co, Cu and Al. As has been discussed earlier, the Si concentration of the wear-resistant iron-based sintered contact material is preferably 0.7 to 1.3 wt % in order to assure that the Si content of the martensite parent phase is 0.8 to 1.7 wt %, and the amount of V is preferably 1.5 to 4.0 wt % for the same reason as in the third invention.

With a view to utilizing the temper softening resistance property of Si to a full extent and avoiding use of large amounts of Mo and V, a more economical wear-resistant iron-based sintered contact material has been developed in which the parent phase contains 1.7 to 3.0 wt % Si, 1.0 to 3.1 wt % Mo and further contains 0.1 to 0.35 wt % V. This wear-resistant iron-based sintered contact material at least contains 2.5 to 3.7 wt % C, 1.3 to 2.3 wt % Si and 8 to 13.5 wt % Cr as indispensable elements, contains either or both of 1.5 to 5 wt % Mo and 0.4 to 2.0 wt % V, and further contains one or more elements selected from the group consisting of Mn, Ni, W, Co, Cu and Al (a fifth invention).

Addition of Si and Al has the effect of markedly increasing the A3 transformation temperature to the high temperature region so that occurrence of thermal cracking at the sliding contact surface can be apparently restricted (ΔA3=+40° C./Si wt %, Mo: +20° C./Mo wt %, Al: +70° C./Al wt %, V: +40° C./V wt %, W: +12° C./W wt %, Mn: −30° C./Mn wt %, Ni: −15° C./Ni wt %).

While the brittle $Cr_7C_3$-type carbide is precipitately dispersed in the third, fourth and fifth inventions in random order, the sixth, seventh and eighth inventions use a face-centered cubic crystal structure that is higher in cleavage plane strength than the $Cr_7C_3$ carbide. In the sixth to eighth inventions, 10 to 20% by volume $M_6C$ ($Fe_3Mo_3C$, $Fe_3W_3C$, $Fe_3(Mo, W)_3C$) carbide is precipitately dispersed, the $M_6C$ carbide having high hardness in the higher temperature region of 400° C. or more. While reducing the percentage of the $Cr_7C_3$-type carbide, the total amount of the carbides is set to 25 to 45% by volume or less. Further, a martensite parent phase composition having the same degree of temper softening resistance as that of the third invention is employed, thereby improving the seizure resistance and wear resistance of the floating seal which are a problem when the floating seal is used under high surface pressure (linear load) and high speed condition.

The compositions of the wear-resistant iron-based sintered contact materials of the sixth, seventh and eighth inventions are calculated similarly to the third, fourth and fifth inventions.

The wear-resistant iron-based sintered contact material of the sixth invention contains at least 2.0 to 3.6 wt % C, 0.2 to 1.8 wt % Si, 8 to 18 wt % Cr and 1.0 to 10.0 wt % Mo as indispensable elements. In cases where importance is given to wear resistance, it contains 0.7 to 3.5 wt % V and further contains one or more elements selected from the group consisting of Mn, Ni, W, Co, Cu and Al.

The propensity of V to concentrate in the $M_6C$-type carbide is small, namely, about one third the concentration of V in the $Cr_7C_3$-type carbide which is in equilibrium with the martensite parent phase. Precipitation of larger amounts of the $M_6C$-type carbide advantageously reduces the amount of V which is contained in the wear-resistant iron-based sintered contact material to enhance the temper softening resistance of the martensite parent phase. Therefore, it is desirable to positively add V. More preferably, the wear-resistant iron-based sintered contact material of the sixth invention contains 2.0 to 3.6 wt % C, 0.05 to 1.8 wt % Si, 8 to 18 wt % Cr and 3.5 to 7.5 wt % Mo as indispensable elements. In cases where importance is given to wear resistance, it preferably contains 1.5 to 3.5 wt % V.

The wear-resistant iron-based sintered contact material of the seventh invention contains at least 2.0 to 3.6 wt % C, 0.05 to 1.8 wt % Si, 3.5 to 11 wt % Cr and 3.0 to 18.0 wt % Mo as indispensable elements. In cases where importance is given to wear resistance, it contains 0.7 to 3.5 wt % V. It may further contain one or more elements selected from the group consisting of Mn, Ni, W, Co, Cu and Al. More preferably, the wear-resistant iron-based sintered contact material of the seventh invention contains 2.0 to 3.0 wt % C, 5 to 9 wt % Cr, 4.5 to 13 wt % Mo and 1.5 to 3.5 wt % V.

The wear-resistant iron-based sintered contact material of the eighth invention contains at least 2.0 to 3.6 wt % C, 1.7 to 3.2 wt % Si, 3.5 to 11 wt % Cr and 1.5 to 16.0 wt % Mo as indispensable elements. In cases where importance is given to wear resistance, it contains 0.7 to 2.0 wt % V. It may further contain one or more elements selected from the group consisting of Mn, Ni, W, Co, Cu and Al. More preferably, the wear-resistant iron-based sintered contact material of the eighth invention contains 2.0 to 3.0 wt % C, 5 to 9 wt % Cr, and 3.0 to 12.5 wt % Mo.

The carbides used in the third to eighth inventions mainly include inexpensive $Cr_7C_3$-type carbide. Since the $Cr_7C_3$-type carbide is brittle, there have been developed, as ninth to eleventh inventions, wear-resistant iron-based sintered contact materials in which the $M_6C$-type carbide is mainly precipitately dispersed in the martensite parent phase having the same composition as those of the third to fifth inventions. More concretely, the amount of the $Cr_7C_3$-type carbide to be precipitately dispersed is limited to 20% by volume or less while the $M_6C$-type carbide is added in an amount of 15 to 40% by volume so that the total amount of the carbides becomes 25 to 45% by volume. With this arrangement, the wear resistance and seizure resistance of the wear-resistant iron-based sintered contact material is improved.

In the ninth invention, the composition of a wear-resistant iron-based sintered contact material comprising a parent phase which contains 0.5 wt % C, 0.05 to 1.7 wt % Si, 4.5 to 7.0 wt % Cr, 1.0 to 2.0 wt % Mo and 0.2 to 0.7 wt % V was calculated. As a result, there has been developed a wear-resistant iron-based sintered contact material comprising at least 1.8 to 2.6 wt % C, 0.06 to 2.3 wt % Si, 6 to 14 wt % Cr and 3.6 to 15.5 wt % Mo as indispensable elements. In cases where importance is given to wear resistance, it contains 0.7 to 3.0 wt % V. It may further contain one or more elements selected from the group consisting of Mn, Ni, W, Co, Cu and Al. More preferably, the wear-resistant iron-based sintered contact material of the ninth invention contains 7 to 12 wt % Cr, 3.6 to 12.5 wt % Mo and 1.5 to 4.0 wt % V.

In the tenth invention, the composition of a wear-resistant iron-based sintered contact material comprising a parent phase which contains 0.5 wt % C, 0.05 to 1.7 wt % Si, 2.0 to 4.5 wt % Cr, 1.5 to 4.0 wt % Mo and 0.2 to 0.7 wt % V was calculated. As a result, there has been developed a wear-resistant iron-based sintered contact material comprising at least 1.8 to 2.6 wt % C, 0.06 to 2.3 wt % Si, 3.5 to 8.5 wt % Cr and 5.5 to 20 wt % Mo as indispensable elements. In cases where importance is given to wear resistance, it contains 0.7 to 3.0 wt % V. It may further contain one or more elements selected from the group consisting of Mn, Ni, W, Co, Cu and Al. In view of the economical efficiency of Cr, Mo and V, it is apparently preferable that the wear-resistant iron-based sintered contact material of the tenth invention contain 1.0 to 2.3 wt % Si, 3.5 to 7.0 wt % Cr, 8 to 17 wt % Mo and 1.5 to 3.0 wt % V.

In the eleventh invention, the composition of a wear-resistant iron-based sintered contact material comprising a parent phase which contains 0.5 wt % C, 1.7 to 3.0 wt % Si, 2.0 to less than 4.5 wt % Cr, 1.0 to 2.5 wt % Mo and 0.2 to 0.35 wt % V was calculated. As a result, there has been developed a wear-resistant iron-based sintered contact material comprising at least 1.8 to 2.4 wt % C, 1.8 to 3.5 wt % Si, 3.5 to 8.5 wt % Cr and 4.0 to 17 wt % Mo as indispensable elements. In cases where importance is given to wear resistance, it contains 0.7 to 1.5 wt % V. It may further contain one or more elements selected from the group consisting of Mn, Ni, W, Co, Cu and Al. In view of the economical efficiency of Si, Cr, Mo and V, it is apparently preferable that the wear-resistant iron-based sintered contact material of the eleventh invention contain 3.5 to 7.0 wt % Cr, 4 to 14 wt % Mo and 1.5 to 3.0 wt % V.

In the third to eleventh inventions, although W does not enhance the temper softening resistance of the parent phase to the same extent as V and Mo do, the effect of W and V upon the temper softening resistance increases until temperature rises up to 600° C. or more, whereas the effect of Mo, Cr and the like on the temper softening resistance increases until temperature rises up to 500 to 550° C. Among all, W is often used in SKD2, SKD4, SKD5, SKD62 and high speed steels. In view of the facts that the sintering temperature employed in the manufacture of the above wear-resistant iron-based sintered contact materials is 1100 to 1250° C., that the effective amount of W which contributes to enhancement of the temper softening resistance is 2 wt % and that the effect of Cr and Si upon Mo is equivalent to that of W, it is desirable to set the upper limit of the amount of W contained in the martensite parent phase to 2.0 wt %. In the case of a wear-resistant iron-based sintered contact material in which 20 to 45% by volume the carbides are precipitately dispersed, it is desirable to set the upper limit of W to a value half the amount of Mo (because the upper limit of the amount of Mo is 4 wt % and when the amount of W is half the amount of Mo, the propensity of W to concentrate in the $Cr_7C_3$ and $M_6C$-type carbides is substantially equal to that of Mo). Taking account of economical efficiency, up to half the amount of Mo can be replaced with W (a twelfth invention).

In Japanese Patent Application Nos. 2002-240967 and 2002-135274, the effect of Al addition on the temper softening resistance of the martensite parent phase is disclosed. According to this, Al and Si have substantially the same remarkable effect on the temper softening resistance and the effect of Al and Si on the temper softening resistance is more significant than that of alloy elements such as V, Si, Mo, Cr and the like, particularly, in the low temperature region up to about 300° C. Therefore, it is desirable for any of the third to twelfth inventions to positively add Al and to replace a part of Si with 0.2 to 1.5 wt % Al in the martensite parent phase (a thirteenth invention).

As disclosed in Japanese Patent Application Nos. 2002-240967 and 2002-135274, coexistence of Al and Ni markedly improves the toughness of the martensite parent phase and therefore it is preferable that the martensite parent phase contain 0.3 to 3.5 wt % Ni.

Ni is an element for compensating for the hardenability of a wear-resistant iron-based sintered contact material similarly to Mn. As disclosed in Japanese Patent Application Nos. 2002-240967 and 2002-135274, Ni functions to improve the toughness of the martensite parent phase when 0.2 wt % or more Al and 0.3 wt % or more Ni coexist within the martensite parent phase, and Ni, Al and Si, which hardly react with the carbides, precipitate an intermetallic compound and cure at a temperature of 500° C. or more. In view of this as well as the positive utilization of the retained austenite described earlier, a preferable amount of Ni contained in the martensite parent phase is 0.3 wt % or more. However, taking account of the fact that Ni significantly stabilizes the retained austenite phase and excessive Ni addition leads to deterioration of wear resistance, the upper limit of the amount of Ni contained in the parent phase is set to 5 wt % and the amount of Ni contained in the wear-resistant iron-based sintered contact material is set to 0.3 to 4.0 wt % (a fourteenth invention).

Co markedly increases the magnetic transformation temperature of the martensite parent phase (about 10° C. per wt % of Co), so that the diffusibility of the alloy elements contained in the parent phase decreases. In addition, since Co increases the temperatures at which other alloy elements effect on the temper softening resistance to a higher degree than the degree of the increase of the magnetic transformation temperature, positive Co addition is preferable. In a fifteenth invention, the amount of Co contained in the parent phase is 3 wt % or more which makes it possible to raise, by about 30° C., the temperature at which the temper softening resistance is obtained. When taking account of the cost of Co, the upper limit of the amount of Co contained in the parent phase is preferably 15 wt %. In a wear-resistant iron-based sintered contact material in which the carbides are precipitately disperesed in an amount of less than 25 to 40% by volume, a preferable amount of Co is 2 to 12 wt %.

Co does not only have the effect of improving the temper softening resistance through magnetic transformation but also considerably cures owing to the precipitative curing of the intermetallic compound caused by Al addition (described later) as disclosed in Japanese Patent Application No. 2002-135275. Therefore, it is apparently desirable to positively add Co up to an amount of 12 wt % (the Co content of the martensite parent phase is 15 wt %).

Mn is an alloy element that compensates for the hardenability of a wear-resistant iron-based sintered contact material but hardly contributes to an improvement in the temper softening resistance. In view of the fact that there are steels containing Mn up to about 2.0 wt % like the AISI standard tool steel A10 and since it has been found from the preliminary test that the retained austenite phase is generated in large amounts in a quenched state by addition of 3 wt % Mn, the maximum amount of Mn contained in the wear-resistant iron-based sintered contact material of a sixteenth invention is set to 2.0 wt %.

It is well known that addition of either or both of 0.1 to 1.0 wt % P and 0.01 to 0.2 wt % B to a sintered contact material is desirable in the light of improving the sinterability of the wear-resistant iron-based sintered contact material (the sixteenth invention).

Although the effect of addition of Nb, Ti, Ca, Ta, Zr and the like is insignificant in the third to sixteenth inventions, they cannot be avoided if the base material originally contains them. For the reason that these elements do not spoil the objects of the invention when they are included, they may be contained in an amount of 1 wt % or less.

Although there have been few reports associated with improving of the martensite parent phase of the material of a floating seal used under a higher surface pressure (higher linear load) and higher speed condition, the seizure resistance of a floating seal material is improved in a seventeenth invention, utilizing the facts that exothermic heat generated at the time of adhesion can be adsorbed by changing the $Fe_3Al$ ordered phase into the martensite phase through Al addition and that the ordered martensite phase is extremely stabilized in terms of free energy and therefore unlikely to adhere.

More specifically, as disclosed by us in Japanese Patent Application No. 2002-135275, Al contained in the martensite parent phase exerts its effect when its amount is 3 wt % or more. Since the $Cr_7C_3$-type carbide and/or $M_6C$-type carbide precipitate in large amounts like the invention and Al, which is hardly dissolved in these carbides, concentrates in the martensite parent phase, Al addition apparently has an effect on the wear-resistant iron-based sintered contact material when its amount is 1.5 wt % or more. The upper limit of the amount of Al is equivalent to the amount of Al which forms an $Fe_3Al$ or FeAl ordered phase. In the invention, the upper limit of the amount of Al is set to 15 wt % on the ground that addition of 15 wt % Al causes a remarkable action of an $Fe_3Al$ ordered phase. A preferable amount of Al contained in the wear-resistant iron-based sintered contact material is 12 wt % or less.

As disclosed by us in Japanese Patent Application No. 2002-135275, it is preferable to add Cu for the purpose of improving the sinterability of a material to be sintered. However, if the amount of Cu exceeds 25 wt %, the Cu phase precipitates in large amounts, which is unfavorable to wear resistance. Therefore, the upper limit of the amount of Cu is set to 25 wt % (an eighteenth invention).

In the methods of producing a wear-resistant iron-based sintered contact material according to the first to eleventh inventions, sinter density on the basis of relative density is increased to 93% or more by partial generation of liquid phases during the sintering process and therefore, the compact is significantly shrunk which makes it difficult to ensure the dimensional accuracy of the sintered compact. This causes an increase in the quantity of machining the sintered compact and, in consequence, an increase in the cost. Therefore, there is provided, according to a nineteenth invention, a wear-resistant iron-based sintered composite contact component produced by sinter-bonding a compact to a backing metal in order to ensure the dimensional accuracy of the sintered compact.

Where this wear-resistant iron-based sintered composite contact component is used as a thrust washer for example, it is desirable to employ a sinter-bonding method by use of a backing metal the outer circumferential surface of which is in contact with or slightly smaller than the inner circumferential surface of a thin, cylindrical (disk-shaped) compact and/or a sinter-bonding method by use of a backing metal having a shape which fits the upper or lower surface and inner circumferential surface of a compact. In the latter method by use of a backing metal having a shape which fits the upper or lower surface and inner circumferential surface of a compact, gas and excessive liquid phases generated during sinter bonding are likely to cause bulges and exfoliation on the bonded surfaces and therefore it is advisable to provide the compact and/or backing metal with one or more gas vent lines or vent holes in order to allow the gas and excessive liquid phases to be discharged from the bonded surfaces of the compact and the backing metal. Generally, the compact to be subjected to sinter bonding is produced by blending, in compliance with the composition of the wear-resistant iron-based sintered contact material, an alloy steel powder, graphite, other alloy elements and about 1 wt % a lubricant such as zinc stearate, stearic acid based wax and the like, and then press forming the blended powder at a high pressure of 4 to 6 tons/$cm^2$ in order to impart handling strength and chipping resistance to the compact. In this case, there might occur upward warping of the compact in the backing metal bonded area. Therefore, there is provided, as a twenty-seventh invention, a method of producing a wear-resistant iron-based sintered composite contact component. According to this method, for assuring the handling strength of the compact and substantially uniformly distributing the pressure applied at the time of press forming, a wax serving as a lubricant for the compact is added in an amount of about 20 to 35% by volume (2.5 to 5 wt %) with respect to the mixed powder of the wear-resistant iron-based sintered contact material. The mixed powder including the wax is formed into granules having a diameter of 2 mm or less in order to facilitate filling of the die with the mixed powder. Then, the mixed powder is pressed under a low pressure of 0.4 to 3.5 ton/$cm^2$. The compact thus formed is bonded to the backing metal, by accelerating sintering while facilitating the retention of the liquid phases generated during sinter bonding within the sintered body and increasing the conformability of the compact relative to the shape of the backing metal. In consequence, the wear-resistant iron-based sintered composite contact component is produced which is free from upward warping occurring at the time of sinter-bonding and bulges etc. caused by foaming of the liquid phase sintered compact. In the sinter-bonding method in which is used a backing metal having a shape that fits the upper or lower surface and inner circumferential surface of the compact, as the bonding area increases, a bonding defect is more likely to occur, the defect being caused by gas generated during sinter bonding and confined in the bonding space enclosed by the upper or lower surface and the inner circumferential surface. Therefore, there has been provided, as a twenty-eighth invention, a producing method capable of preventing a bulging defect caused by gas confinement during sinter bonding by providing the compact and/or the backing metal with one or more gas vent lines and/or gas vent holes for allowing the gas to escape from the space. According to the sinter bonding method of the twenty-eighth invention, the compact has higher concentrations of Cr and Al and therefore, sinter bonding is preferably carried out in an atmosphere of AX gas having a dew point of −30° C. or less or a vacuum of at least 1 torr or less. In the light of cost, it is apparently desirable to quench-harden the wear-resistant iron-based sintered contact material portion by gas cooling with $N_2$ or the like under a pressure of 100 torr or more in a cooling process subsequent to sinter bonding.

When producing a simple, thin, cylindrical-plate-like thrust washer or the like, the dimensional accuracy of the outer diameter of the sintered compact portion cannot be ensured even with the method in which the inner circumferential surface of the compact is brought into contact with the backing metal. Therefore, there has been developed a low-strain wear-resistant iron-based sintered composite contact component that can be used as a thrust washer. In this component, its surface layer is composed of two layers of wear-resistant iron-based sintered contact materials having substantially the same composition and an intermediate layer that is disposed between the two layers. The intermediate layer consists of an iron-based sintered material layer made from a material having a composition different from those of the two layers and exerting lower contractibility or expandability during sinter bonding. Alternatively, the intermediate layer consists of an iron-based backing metal member.

The above wear-resistant iron-based sintered composite contact component is applicable as a floating seal used for oil sealing purpose in the track rollers, track carrier rollers, idler rollers, mechanical reduction gears and the like of a construction machine. This component is also applicable as a thrust washer for use in the joint part of a work implement in a construction machine and can also be sinter-bonded and adhered to the end faces of a bushing for use in a crawler track of a construction machine.

BEST MODE FOR CARRYING OUT THE INVENTION

Referring now to the accompanying drawings, there will be concretely described wear-resistant sintered contact materials, wear-resistant sintered composite contact components and methods of producing the same according to the invention.

EXAMPLE 1

The Result of a Preliminary Test

In this example, the high-carbon high-Cr wear-resistant steels shown in TABLE 1 were used and the amount of retained austenite formed by quenching was checked. Further, an abrasion test was conducted by use of a grind stone to check changes in the amount of the retained austenite formed on the sliding contact surface of each steel.

TABLE 1

A survey of retained austenite in wear-resistant steels (constituent table wt %)

| | No. | C | Si | Mn | Cr | Mo | V | Others |
|---|---|---|---|---|---|---|---|---|
| SKD1 | A1 | 2.02 | 0.3 | 0.43 | 12.48 | | | |
| SKD11 | A2 | 1.54 | 0.2 | 0.35 | 11.32 | 0.91 | 0.28 | |
| RH12 | A3 | 0.96 | 0.49 | 0.53 | 12.93 | | | |
| RH40 | A4 | 0.62 | 0.29 | 0.4 | 13.33 | | | |
| SUS57 | A5 | 1.07 | 0.47 | 0.51 | 15.88 | 0.51 | | 0.17Ni |
| SKD12 | A6 | 0.97 | 0.38 | 0.88 | 4.97 | 0.9 | 0.29 | |
| $10Cr_3Mn$ | A7 | 1.75 | 0.33 | 3.6 | 10.53 | | | |
| $6Cr_7Mn$ | A8 | 1.87 | 0.33 | 6.93 | 6.2 | | | |

Figure 1:
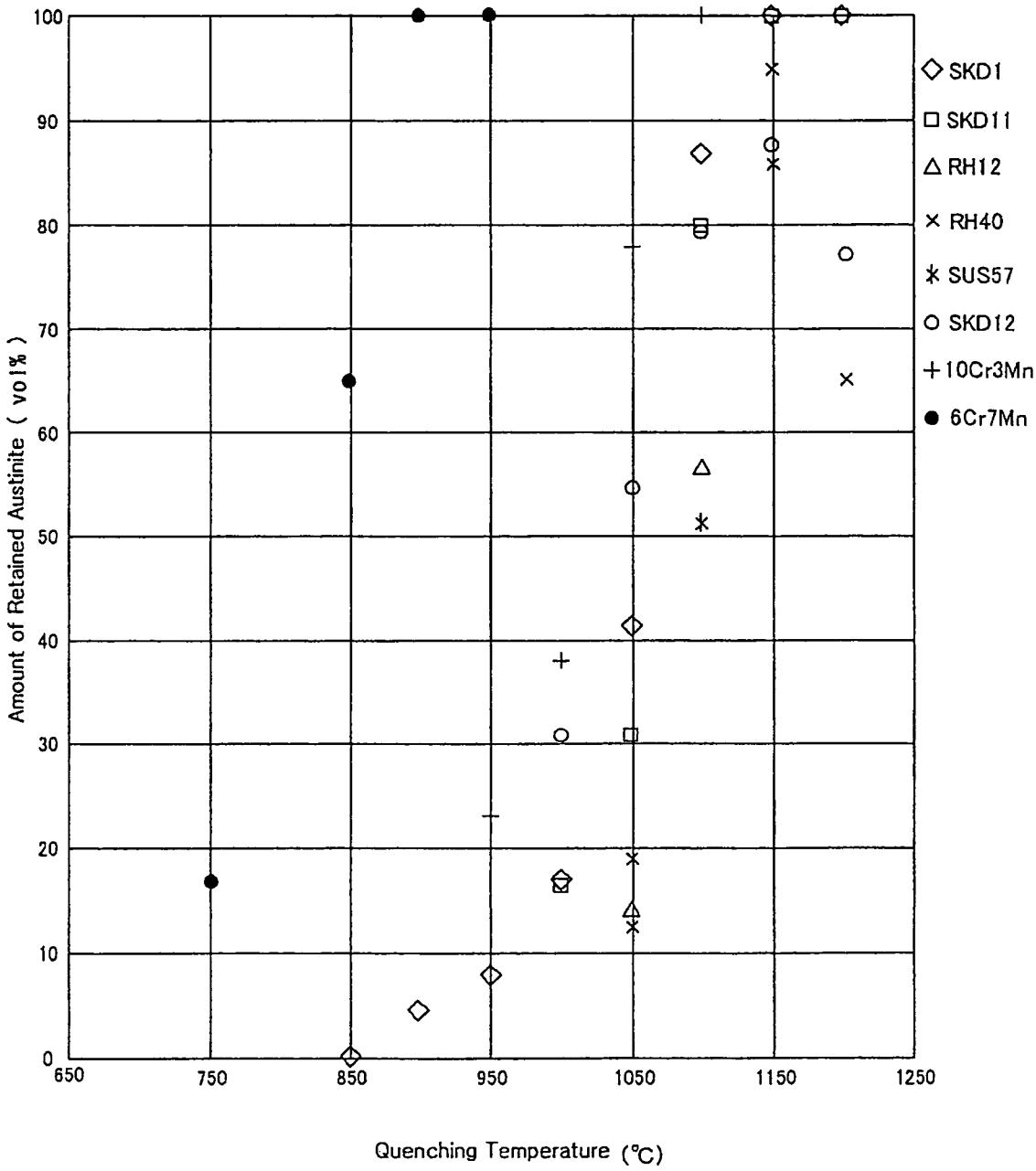
FIG. 1 is a graph showing the relationship between quenching temperature and the amount of a retained austenite phase.
Figure 2:
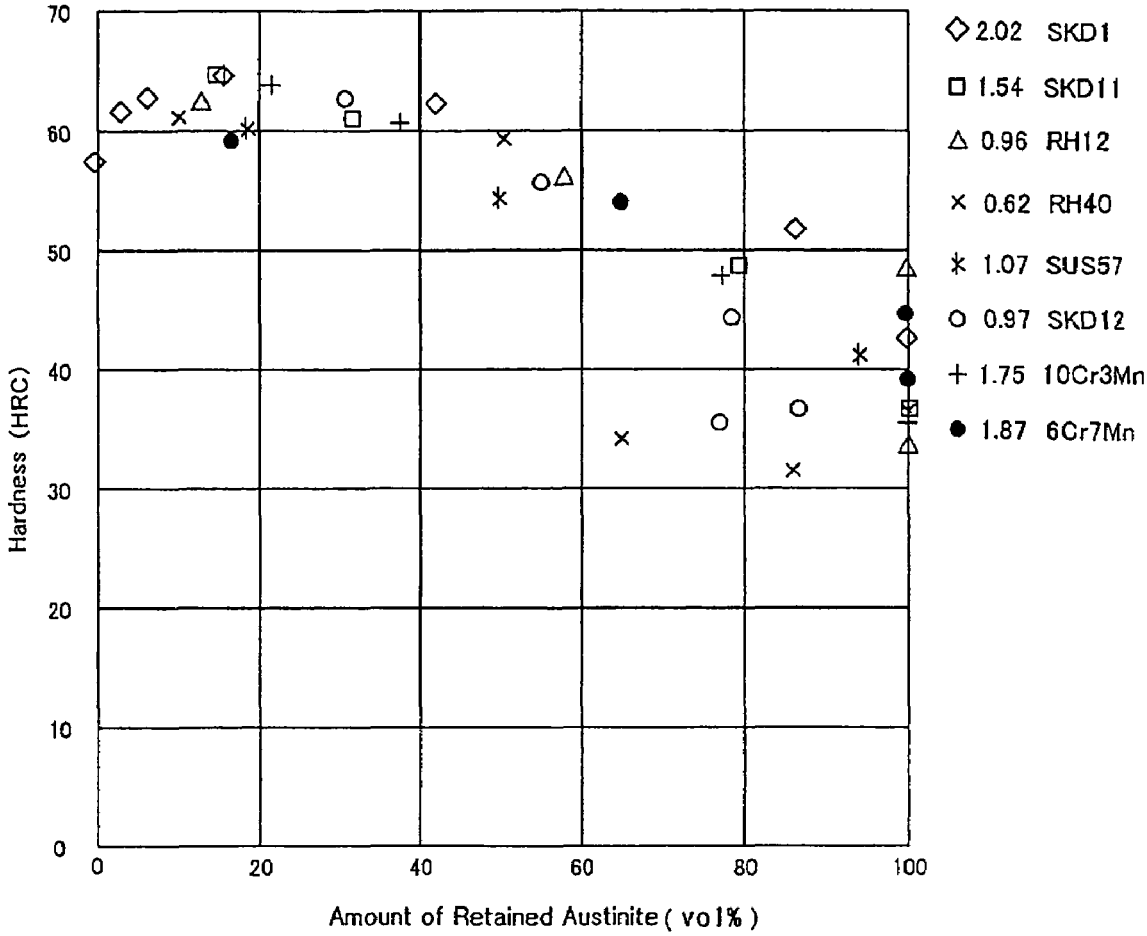
FIG. 2 is a graph showing the relationship between a retained austenite phase and hardness.
Figure 3:
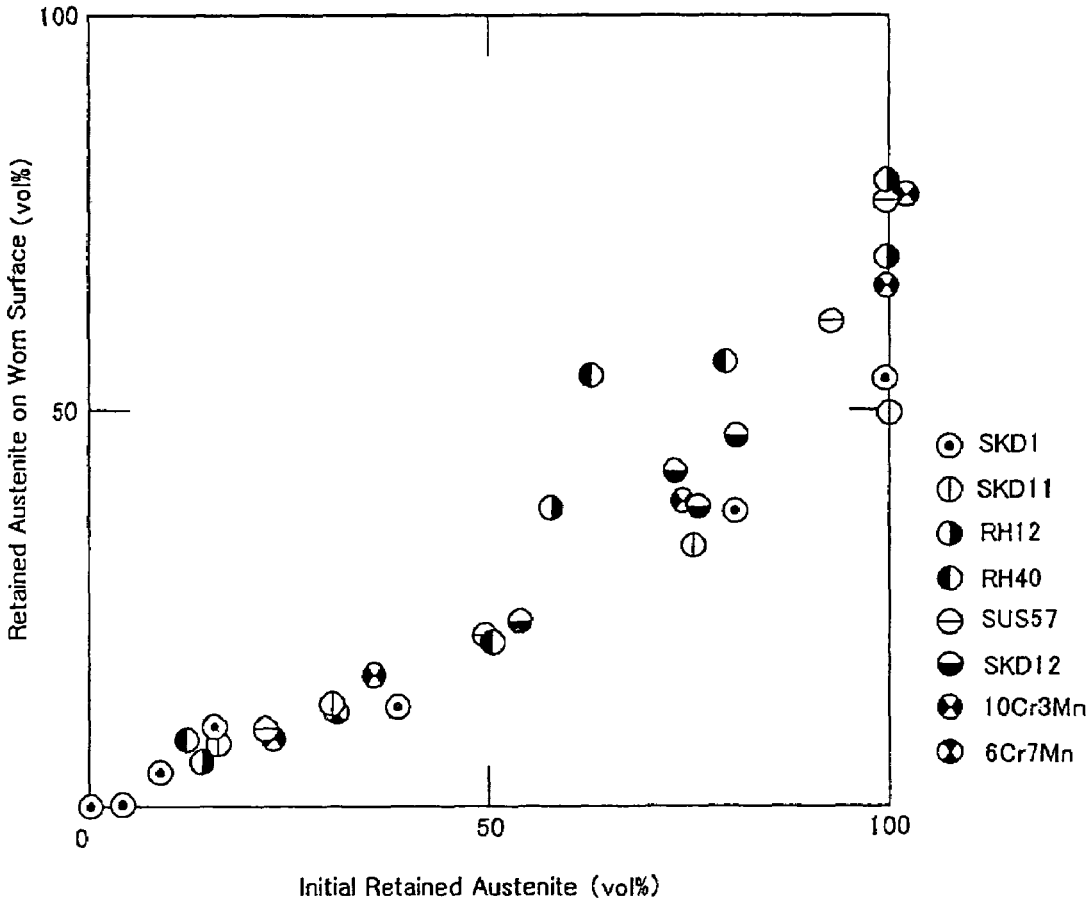
FIG. 3 is a graph showing the relationship between the amounts of a retained austenite phase before and after a friction test.

FIG. 1 shows the relationship between quenching temperature and the amount of a retained austenite phase, whereas FIG. 2 showing the relationship between a retained austenite phase and hardness. FIG. 3 shows the relationship between the amounts of a retained austenite phase before and after a friction test. As obvious from these figures, the amount of the retained austenite phase rapidly increases as the quenching temperature rises and reaches 60% by volume or more at a quenching temperature of 1100° C. or more (See FIG. 1). In terms of hardness, when the retained austenite is 60% by volume or more, there is a high possibility that a hardness of HRC 50 or more cannot be ensured (See FIG. 2). It is understood from the quantitative relationship graph (See FIG. 3) of the retained austenite phase checked before and after an abrasion test that about 50% of the retained austenite phase existing in amounts of 60% by volume or less before conducting the test is changed to a strain induced martensite phase by a stress occurring at the sliding contact surface during abrasion and the surface of the strain induced martensite phase is considerably hardened so that wear resistance hardly drops and that if the amount of the retained austenite phase is 60% by volume or more, the retained austenite phase itself becomes more stable so that a decrease in wear resistance is observed.

Therefore, if the wear-resistant iron-based sintered contact material sintered at a temperature of 1100 to 1250° C. is quenched from this sintering temperature range, there arises the problem that 60% by volume or more the retained austenite phase is formed. Therefore, it is understood that quenching is preferably carried out after cooling the furnace to a quenching temperature of 900 to 1100° C. subsequently to sintering.

EXAMPLE 2

A Survey of Equilibrium Compositions at Sintering Temperatures for Wear-resistant Iron-based Sintered Contact Materials In this example, an alloy powder having a composition of Fe—0.6 wt % C—0.3 wt % Si—0.45 wt % Mn—15 wt % Cr—3 wt % Mo—1.2 wt % V and an alloy powder having a composition of Fe—0.6 wt % C—0.3 wt % Si—0.35 wt % Mn—9 wt % Cr—6 wt % Mo—4 wt % W—1.2 wt % V were used as a base material. Further, Ni, Co, Si, FeAl, FeP powders of #350 meshes or smaller and a graphite powder having an average particle diameter of 6 μm were used. These powders were blended thereby preparing three kinds of mixed alloy powders for sintering as shown in TABLE 2. After 3 wt % paraffin wax was added, these mixed powders for sintering were pressed under a pressure of 1.0 ton/cm$^2$ to prepare green bodies having compositions A, B and C. Then, the compacts A and B were subjected to two-hour vacuum sintering at 1190° C., whereas the compact C was subjected to the same at 1135° C. After the furnace was cooled to 1000° C., quenching by cooling was carried out in an atmosphere of nitrogen gas at 400 torr. The sintered test specimens thus prepared were then cut and ground, and the martensite parent phase of each test specimen and the concentrations of alloy elements contained in the carbides that precipitately disperse in the parent phase were checked using an X-ray micro-analyzer. The result of this analysis is shown in TABLE 3.

TABLE 2

| | Compositions of sintered alloys prepared for EPMA analysis (wt %) | | | | | | | | | | |
|---|---|---|---|---|---|---|---|---|---|---|---|
| | G | Si | Al | Mn | Cr | Mo | V | W | Ni | Co | P |
| A | 3 | 0.6 | 0.7 | 0.4 | 15 | 3 | 1.3 | — | 2 | 3 | 0.25 |
| B | 3 | 0.6 | — | 0.4 | 15 | 3 | 1.5 | — | 4 | — | 0.25 |
| C | 3 | 0.6 | — | 0.2 | 9 | 6 | 2 | 4 | 4 | — | 0.3 |

TABLE 3

| | The result of EPMA analysis of sintered seals (wt %) | | | | | | | | | | |
|---|---|---|---|---|---|---|---|---|---|---|---|
| | No. | Phase and K | C | Si | Al | Cr | Mo | V | W | Ni | Co |
| PM15Cr3Mo3Co | A | parent phase | 0.4 | 0.8 | 0.9 | 6.2 | 2.1 | 0.27 | | 2.1 | 4 |
| | | $M_7C_3$ | 8.45 | 0.04 | 0.02 | 40 | 4.9 | 4.7 | | 0.2 | 0.9 |
| | | $KM_7$ | | 0.05 | 0.02 | 6.45 | 2.33 | 17.41 | | 0.10 | 0.23 |
| PM15Cr3Mo4Ni | B | parent phase | 0.43 | 0.86 | | 7.12 | 2.16 | 0.34 | | 5.2 | |
| | | $M_7C_3$ | 8.42 | 0.03 | | 39.9 | 4.96 | 4.67 | | 0.36 | |
| | | $KM_7$ | | 0.03 | | 5.60 | 2.30 | 13.74 | | 0.07 | |
| PM9Cr6Mo4W | C | parent phase | 0.44 | 0.85 | | 4.27 | 1.52 | 0.37 | 1.23 | 5.33 | 4.96 |
| | | $M_7C_3$ | 7.61 | 0.04 | | 27.7 | 3.72 | 6.79 | 3.61 | .49 | 1.2 |
| | | $KM_7$ | | 0.05 | | 6.49 | 2.45 | 18.35 | 2.93 | 0.09 | 0.24 |
| | | $M_6C$ | 1.85 | 2.02 | | 4.08 | 30.3 | 2.1 | 28.4 | 2.11 | 2.46 |
| | | $KM_6$ | | 2.38 | | 0.96 | 19.93 | 5.68 | 23.09 | 0.40 | 0.50 |

The sintered alloys A, B are formed by adding 3 wt % Co and 4 wt % Ni to a high-Cr, 15Cr-3Mo-based alloy and only the martensite parent phase is in equilibrium with the $Cr_7C_3$-type carbide. The sintered alloy C is such that the concentrations of M and W are increased thereby making the $Cr_7C_3$-type carbide and the $M_6C$-type carbide be in equilibrium with each other within the martensite parent phase.

In the columns of Parent Phase, $M_7C_3$ and $M_6C$ of TABLE 3, the concentrations of their constituent alloys are indicated. $KM_7$ indicates the distribution coefficient of each alloy element M within the $M_7C_3$ carbide relative to the alloy element M within the parent phase (alloy element (wt %) contained in the $M_7C_3$-type carbide/alloy element (wt %) contained in the parent phase). $KM_6$ indicates the distribution coefficient of each alloy element within the $M_6C$-type carbide relative to the alloy element within the parent phase (alloy element (wt %) contained in the $M_6C$-type carbide/alloy element (wt %) contained in the parent phase). By comparison between these distribution coefficients of each alloy element, the characters of the alloy element can be examined.

Figure 4:
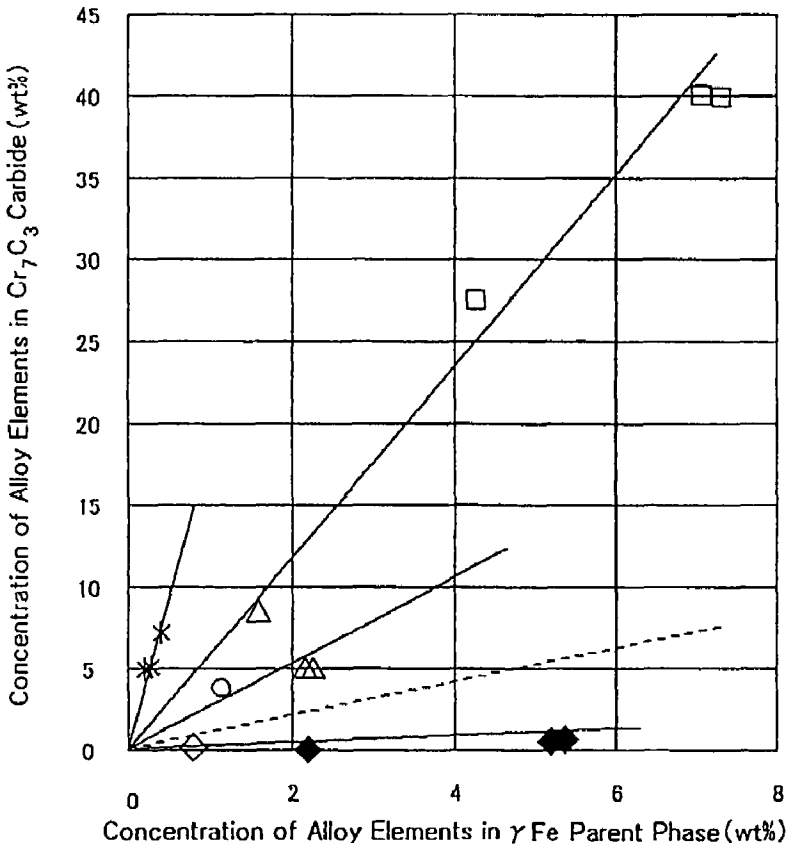
FIGS. 4(*a*) and 4(*b*) are graphs showing the relationship between the concentration of each alloy element contained in $M_7C_3$-type and $M_6C$-type carbides and the concentration of the alloy element contained in a parent phase, the $M_7C_3$-type and $M_6C$-type carbides being in equilibrium with the parent phase.
Figure 4:
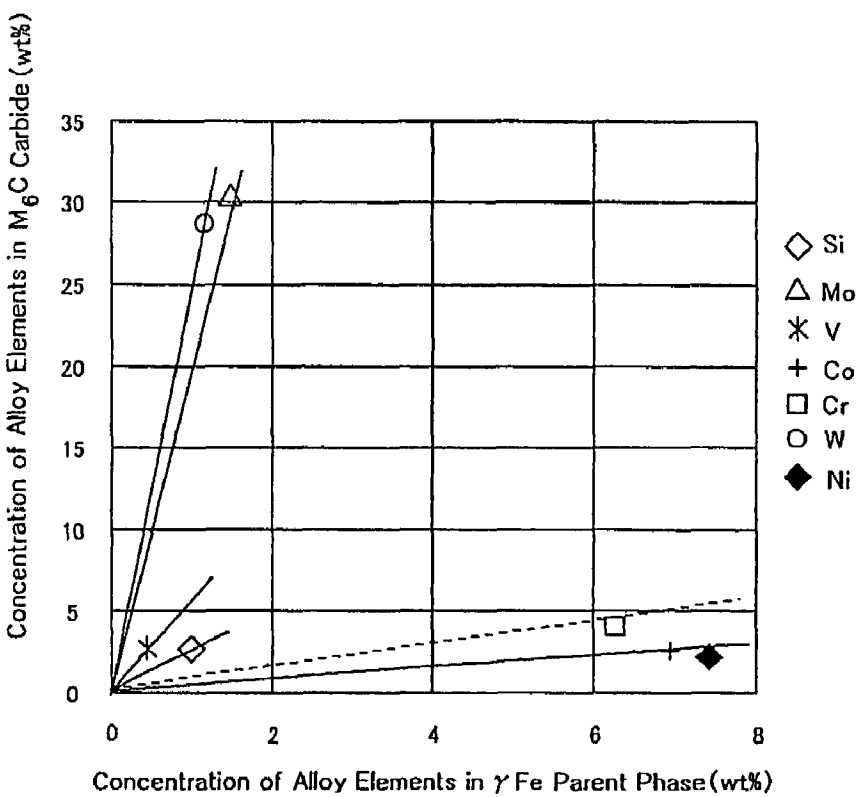

The result of the above examination is used for obtaining the graphs of FIGS. 4(*a*), 4(*b*) which show the relationship between the concentration of each alloy element contained in the $M_7C_3$-type and $M_6C$-type carbides and the concentration of the alloy element contained in the parent phase, the $M_7C_3$-type and $M_6C$-type carbides being in equilibrium with the parent phase. It is understood from these figures that each alloy element is distributed at a substantially constant ratio and that even when the composition of the wear-resistant iron-based sintered contact material varies, the distribution coefficient is substantially the same.

For instance, the following points are quantitatively understood from the distribution coefficients of the alloy elements: (i) Si and Al hardly dissolve in the $M_7C_3$-type carbide but the substantially all of them concentrates in the martensite parent phase; (ii) the concentration of V in the $M_7C_3$-type carbide is higher than those of Cr, Mo and W; (iii) Mo and W concentrate in higher amounts in the $M_7C_3$ carbide than in the $M_6C$-type carbide; and (iv) Ni and Co do not concentrate in any carbides but concentrate in the martensite parent phase.

TABLE 4 shows the result of an analysis of the martensite parent phase compositions and carbide quantities of typical SKD and SKH tool steels based on the distribution coefficients of the alloy elements. Characteristically, in the martensite parent phases of these steel products, the amount of Cr is adjusted to 3.5 to 7.5 wt %, and 0.8 to 1.5 wt % Mo and/or 1 to 4.5 wt % W is contained as a basic constituent. Regarding carbide materials, the SKD steels contain hard, inexpensive $Cr_7C_3$-type carbide in an amount of 0 to 20% by volume and a marginal amount of MC ($V_4C_3$)-type carbide, whereas the SKH steels contain 0 to 15% by volume $M_6C$-type carbide having excellent heat resistance and MC-type carbide.

TABLE 4

An analysis result of the martensite parent phase compositions (wt %) of SKD and SKH steels and the quantities (% by volume) of carbides dispersed in SKD and SKH steels

| | steel codes | C | Si | Mn | Cr | Mo | W | V | Co | the quantities of carbides (% by volume) $Cr_7C_3$ | $M_6C$ | MC |
|---|---|---|---|---|---|---|---|---|---|---|---|---|
| SKD1 | steel composition | 2.1 | 0.35 | 0.52 | 12.9 | | | | | 18% | | |
| | parent phase composition | 0.7 | 0.43 | | 6.6 | | | | | | | |
| SKD2 | steel composition | 2.08 | 0.32 | 0.53 | 12.7 | | 2.7 | | | 17% | | |
| | parent phase composition | 0.7 | 0.4 | | 6.5 | | 2.1 | | | | | |
| SKD11 | steel composition | 1.46 | 0.37 | 0.44 | 11.8 | 0.95 | | 0.31 | 3.48 | 12% | | |
| | parent phase composition | 0.5 | | | 7.4 | 0.8 | | 0.14 | 3.8 | | | |
| D7 | steel composition | 2.25 | 0.31 | 0.41 | 12.4 | 1.07 | | 4 | | 19% | | 1.60% |
| | parent phase composition | 0.5 | 0.4 | | 6.3 | 0.82 | | 0.7 | | | | |
| SKD12 | steel composition | 0.99 | 0.29 | 0.68 | 4.7 | 0.89 | | 0.39 | | 5% | | |
| | parent phase composition | 0.7 | 0.3 | | 3.8 | 0.8 | | 0.25 | | | | |
| SKD61 | steel composition | 0.38 | 1.02 | 0.39 | 4.8 | 1.2 | | 0.89 | | 0% | | |
| | parent phase composition | 0.38 | 1.02 | | 4.8 | 1.2 | | 0.7 | | | | |
| SKD62 | steel composition | 0.37 | 1.01 | 0.36 | 4.9 | 1.11 | 1.09 | 0.34 | | 0% | | |
| | parent phase composition | 0.37 | 1.01 | 0.36 | 4.9 | 1.11 | 1.09 | 0.34 | | | | |
| SKH2 | steel composition | 0.73 | 0.2 | 0.41 | 4.21 | 0 | 18.6 | 1 | | | 15% | |
| | parent phase composition | 0.5 | 0.16 | | 4.3 | 0 | 4.3 | 0.6 | | | | |
| SKH9 | steel composition | 0.89 | 0.26 | 0.42 | 4.49 | 4.73 | 6.72 | 2.5 | | | 12% | 1.30% |
| | parent phase composition | 0.5 | 0.21 | | 4.5 | 1.45 | 1.8 | 0.7 | | | | |

Note:
$Cr_7C_3$carbide: 8.5 wt % C, $M_6C$carbide: 2 wt % C, MCcarbide: 15 wt % C Except that the SKD 61 and SKD 62 contain Si in the range of 0.8 to 1.2 wt %, the Si contents of most of the SKD and SKH steels are limited to low values, namely, 0.5 wt % or less.

For developing a wear-resistant iron-based sintered contact material having higher temper softening resistance, it is desirable to take account of the parent phase compositions of these SKD and SKH steel products and add appropriate carbides to the steel products so as to disperse therein. In the second to tenth inventions, the hard, inexpensive $Cr_7C_3$-type carbide and the $M_6C$-type carbide having high heat resistance are added in proper amounts and allowed to coexist while increasing the total amount of the carbides to 20 to 45% by volume, and adequate temper softening resistance is achieved by properly setting the amounts of Cr, Mo, Si, V and others contained in the martensite parent phase.

EXAMPLE 3

Preparation of Floating Seals

TABLE 5 shows the compositions of the test specimens of the wear-resistant iron-based sintered contact materials used in this example and their comparative materials. TABLE 5 also shows the type and amount of the carbides precipitately dispersed during sintering in each wear-resistant iron-based sintered contact material.

TABLE 5

The compositions of the sintered material test specimens used in Example 3

| $Cr_7$ % by volume | $M_6C$ % by volume | | | C | Si | Mn | Cr | Mo | W | V | Ni | Co | Al | Cu | P |
|---|---|---|---|---|---|---|---|---|---|---|---|---|---|---|---|
| 40 | No. 1 | parent phase composition | | 0.5 | 1.7 | | 5.5 | 1 | 0 | 0.2 | 2.5 | 0 | 0 | | 0.2 |
| | | steel composition | | 3.70 | 1.03 | | 16.50 | 1.60 | 0.00 | 1.16 | 1.60 | 0.00 | 0.00 | | |
| 25 | No. 2 | parent phase composition | | 0.5 | 1.7 | | 5.5 | 1 | 0 | 0.2 | 0 | 0 | | | 0.2 |
| | | steel composition | | 2.50 | 1.28 | | 12.38 | 1.38 | 0.00 | 0.80 | 0.00 | 0.00 | | | |
| 30 | No. 3 | parent phase composition | | 0.5 | 0.4 | | 6 | 2 | | 0.2 | 2.5 | 0 | | | 0.2 |
| | | steel composition | | 2.90 | 0.28 | | 15.00 | 2.90 | 0.00 | 0.92 | 1.83 | 0.00 | | | |
| 30 | No. 4 | parent phase composition | | 0.5 | 0.4 | | 6 | 2 | 0 | 0.2 | 2.5 | 5 | | | 0.2 |
| | | steel composition | | 2.90 | 0.28 | | 15.00 | 2.90 | 0.00 | 0.92 | 1.83 | 3.85 | | | |
| 30 | No. 5 | parent phase composition | | 0.5 | 0.4 | | 6 | 2 | 0 | 0.2 | 5 | 0 | | | 0.2 |
| | | steel composition | | 2.90 | 0.28 | | 15.00 | 2.90 | 0.00 | 0.92 | 3.65 | 0.00 | | | |
| 30 | No. 6 | parent phase composition | | 0.40 | 0.40 | | 6.00 | 1.00 | | 0.65 | 2.50 | | | | 0.2 |
| | | steel composition | | 2.83 | 0.28 | | 15.00 | 1.45 | 0.00 | 2.99 | 1.83 | 0.00 | | | |
| 30 | No. 7 | parent phase composition | | 0.5 | 0.3 | | 2.5 | 3.5 | | 0.4 | 1.4 | 0 | | | 0.2 |
| | | steel composition | | 2.90 | 0.21 | | 6.25 | 5.08 | 0.00 | 1.84 | 1.02 | 0.00 | | | |
| 30 | No. 8 | parent phase composition | | 0.5 | 4.5 | | 2.5 | 1.7 | | 0.25 | 1.4 | 0 | | | 0.2 |
| | | steel composition | | 2.90 | 3.18 | | 6.25 | 2.47 | 0.00 | 1.15 | 1.02 | 0.00 | | | |
| 30 | No. 9 | parent phase composition | | 0.5 | 0.3 | | 2.5 | 2 | 2 | 0.4 | 1.4 | | | | 0.2 |
| | | steel composition | | 2.90 | 0.21 | | 6.25 | 2.90 | 2.90 | 1.84 | 1.02 | 0.00 | | | |
| 30 | No. 10 | parent phase composition | | 0.6 | 0.3 | | 3.5 | 3 | | 0.2 | 5 | | 1.5 | | 0.2 |
| | | steel composition | | 2.97 | 0.21 | | 8.75 | 4.35 | 0.00 | 0.92 | 3.65 | 0.00 | 1.06 | | |
| 30 | No. 11 | parent phase composition | | 0.5 | 2 | | 3.5 | 2 | | 0.2 | 1.4 | | 1 | | 0.2 |
| | | steel composition | | 2.90 | 1.41 | | 8.75 | 2.90 | 0.00 | 0.92 | 1.02 | 0.00 | 0.71 | | |

TABLE 5-continued

The compositions of the sintered material test specimens used in Example 3

| $Cr_7$ % by volume | $M_6C$ % by volume | | | C | Si | Mn | Cr | Mo | W | V | Ni | Co | Al | Cu | P |
|---|---|---|---|---|---|---|---|---|---|---|---|---|---|---|---|
| 30 | | No. 12 | parent phase composition | 0.5 | 0.5 | | 2.5 | 0.4 | | 0.1 | 0 | | 5 | | 0.2 |
| | | | steel composition | 2.90 | 0.35 | | 6.25 | 0.58 | 0.00 | 0.46 | 0.00 | 0.00 | 3.53 | | |
| 30 | 0 | No. 13 | parent phase composition | 0.5 | 0.5 | | 2.5 | 0.4 | | 0.1 | 0 | 0 | 5 | 15 | 0.2 |
| | | | steel composition | 2.90 | 0.35 | | 6.25 | 0.58 | 0.00 | 0.46 | 0.00 | 0.00 | 3.53 | 10.59 | |
| 20 | 10 | No. 13-2 | parent phase composition | 0.50 | 0.40 | | 6.00 | 1.50 | | 0.60 | 2.00 | 0.00 | | | 0.2 |
| | | | steel composition | 2.25 | 0.37 | | 11.97 | 4.80 | 0.00 | 2.32 | 1.52 | 0.00 | | | |
| 20 | 10 | NO. 14 | parent phase composition | 0.5 | 0.8 | | 3 | 3 | | 0.7 | 2 | | | | 0.2 |
| | | | steel composition | 2.25 | 0.75 | | 5.99 | 9.60 | 0.00 | 2.71 | 1.52 | 0.00 | | | |
| 30 | 10 | NO. 15 | parent phase composition | 0.5 | 1.2 | | 3 | 3 | | 0.6 | 2 | 0 | | | 0.2 |
| | | | steel composition | 3.05 | 1.00 | | 7.49 | 10.05 | 0.00 | 3.04 | 1.34 | 0.00 | | | |
| 20 | 20 | NO. 16 | parent phase composition | 0.5 | 3.3 | | 3 | 2 | | 0.7 | 2 | 0 | | | 0.2 |
| | | | steel composition | 2.40 | 3.51 | | 5.97 | 10.20 | 0.00 | 3.04 | 1.40 | 0.00 | | | |
| 20 | 30 | NO. 17 | parent phase composition | 0.55 | 1.5 | | 3 | 2 | | 0.6 | 2 | | | | 0.2 |
| | | | steel composition | 2.58 | 1.79 | | 5.96 | 14.00 | 0.00 | 2.89 | 1.28 | 0.00 | | | |
| 10 | 40 | NO. 18 | parent phase composition | 0.55 | 1.5 | | 3 | 2 | | 0.6 | 2 | 10 | | | 0.2 |
| | | | steel composition | 1.93 | 2.13 | | 4.44 | 17.50 | 0.00 | 2.45 | 1.34 | 7.23 | | | |
| 10 | 40 | NO. 19 | parent phase composition | 0.55 | 4 | | 3 | 1 | | 0.35 | 2 | | | | 0.2 |
| | | | steel composition | 1.93 | 5.69 | | 4.44 | 8.75 | 0.00 | 1.43 | 1.34 | 0.00 | | | |
| 20 | 25 | NO. 20 | parent phase composition | 0.55 | 1.5 | | 5.5 | 1 | | 0.6 | 2 | | | | 0.2 |
| | | | steel composition | 2.50 | 1.69 | | 10.93 | 6.05 | 0.00 | 2.75 | 1.34 | 0.00 | | | |

Figure 5:
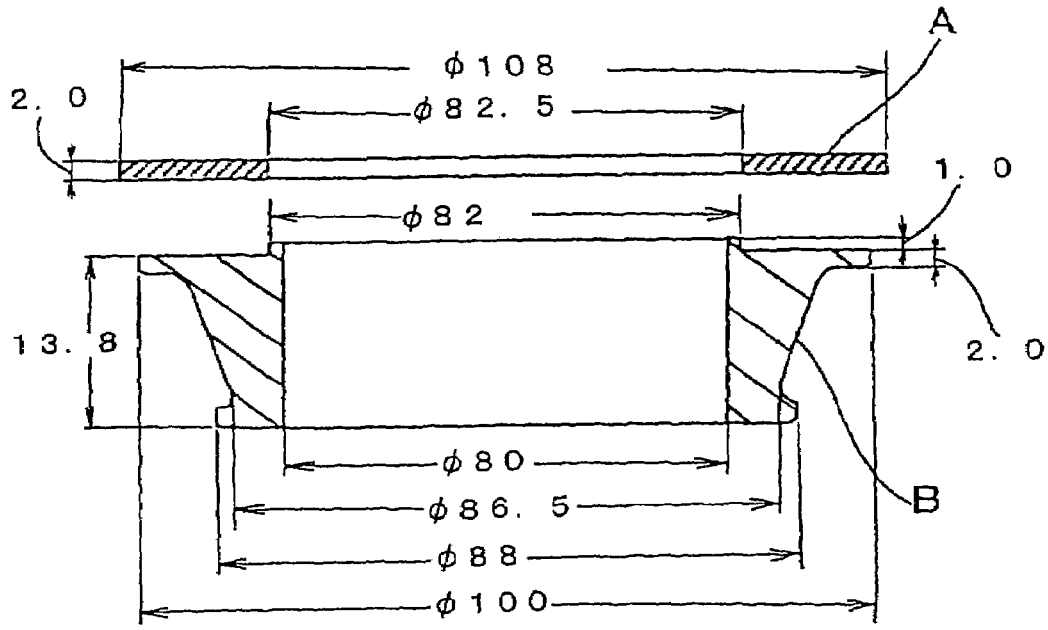
FIGS. 5(*a*) and 5(*b*) show a shape of a test specimen used for a sinter bonding test.
Figure 5:
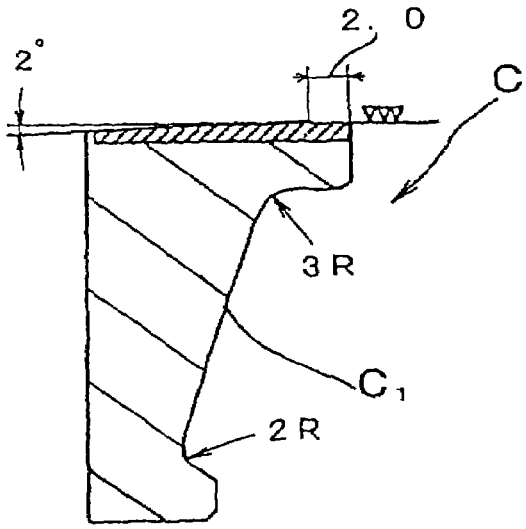

Graphite, Si, Ni, Co, FeAl, FeP which are the same as those of Example 2 and FeMoC, FeWC, FeCrC and FeV alloy powders of #350 meshes or smaller were added to a base steel powder of #150 meshes or smaller so as to prepare wear-resistant iron-based sintered contact materials having the compositions shown in TABLE 5. Then, 3 wt % paraffin wax was added to each of the mixed powders. After mixed and granulated at 100° C. for 10 minutes, using a high-speed mixer, these powders were respectively compressed into a ring-shaped compact A as shown in FIG. 5(*a*) under a compacting pressure of 1 ton/cm$^2$. The compacts thus formed were respectively placed on a base material B made from SS steel and then sinter-bonded at 1100 to 1250° C. within a vacuum furnace for 2 hours such that the relative density of the sintered layer becomes 93% or more. The sintered compacts were then subjected to quenching from 1100° C. under a pressure of 400 torr in an $N_2$ gas atmosphere. After quenching, the compacts were tempered at 550° C. for 2 hours, thereby preparing sinter-bonded test specimens C. There were also prepared test specimens which were formed by carrying out the quenching in an $N_2$ gas atmosphere after cooling the furnace to 1000° C. subsequently to sintering.

Figure 6:
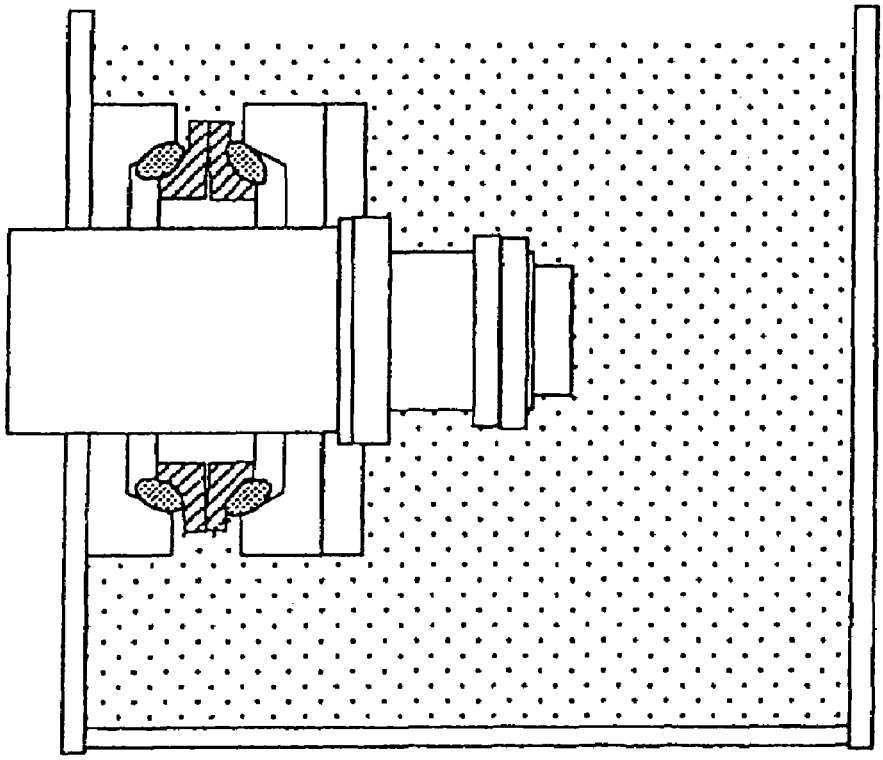
FIG. 6 is a schematic diagram of a floating tester.

The sinter-bonded test specimens C were ground into the shape shown in FIG. 5(*b*) and finished by lapping the seal surface $C_1$ shown in FIG. 5(*b*). These test specimens were put in muddy water containing about 50 wt % $SiO_2$ and tested by use of a sliding tester such as shown in FIG. 6, thereby checking their wear resistance and seizure critical condition. The amount of wear was measured based on the displacement (mm) of a seal's contacting position after a 500-hour continuous test. The seizure critical condition was obtained by checking the rotational speed at which the sliding contact resistance increased, with the seal load (linear load) being set to a constant value. The amount of wear and the seizure critical condition are shown in TABLE 6.

As comparative materials used for comparison with the wear resistance and seizure of the test specimens, there were employed cast iron seal materials (FC15Cr3Mo and FC9Cr6Mo) having a composition of Fe-3.4C-1.5Si-15Cr-2.5Mo-1.5Ni and a composition of Fe-3.5C-1.5Si-9Cr-6Mo-4.5W-2V-2Ni-3Co and the SKD 11 and SKH 9 shown in TABLE 4. The test result of these comparative materials is also shown in TABLE 6.

TABLE 6

The result of a test for checking wear resistance and a seizure critical condition

| Alloy No. | PV value 1100° C. | the amount of wear (mm) 1100° C. | PV value 1000° C. | the amount of wear (mm) 1000° C. |
|---|---|---|---|---|
| NO. 1 | 3 | 0.65 | | |
| NO. 2 | 2.15 | 1.5 | | |
| NO. 3 | 2.45 | 1.1 | | |
| NO. 4 | 3.15 | 0.9 | | |
| NO. 5 | 2.75 | 1.3 | | |
| NO. 6 | 2.9 | 0.7 | | |
| NO. 7 | 3 | 0.45 | 2.85 | 0.6 |
| NO. 8 | 3.4 | 0.5 | | |
| NO. 9 | 3.1 | 0.45 | 2.9 | 0.7 |
| NO. 10 | 2.95 | 0.75 | | |
| NO. 11 | 3.6 | 0.6 | | |
| NO. 12 | 5 | 0.95 | | |
| NO. 13 | 5.25 | 1.05 | | |
| NO. 13-2 | 3.15 | 0.65 | | |
| NO. 14 | 3.7 | 0.35 | 3.6 | 0.55 |
| NO. 15 | 3.6 | 0.45 | | |
| NO. 16 | 3.8 | 0.3 | | |
| NO. 17 | 4.15 | 0.6 | | |
| NO. 18 | 4.6 | 0.25 | | |
| NO. 19 | 4.25 | 0.5 | | |
| NO. 20 | 3.85 | 0.65 | | |
| FC15Cr3Mo | 1.85 | 1.8 | | |
| FC9CR6Mo | 2.45 | 2 | | |
| SKD11 | 1.6 | 4.1 | | |
| SKH9 | 1.8 | 3.2 | | |

The following facts are found from the test result.

(1) Compared to the FC15Cr3Mo cast iron seal, the sintered material Nos. 1 to 6 have higher PV values and wear resistance. This is attributable to the carbide compositions of the sintered materials.

(2) From the comparison between the SKD 11 in which about 12% by volume $Cr_7C_3$-type carbide is dispersed and the material No. 2 containing 25% by volume $Cr_7C_3$-type carbide in terms of seizure resistance and wear resistance, it is understood that the amount of the carbide is preferably 20% by volume or more and more preferably 25% by volume or more.

(3) From the comparison between the material Nos. 3, 4 and 5, it is understood that markedly improved seizure resistance and wear resistance can be obtained by setting the Co content of the martensite parent phase to 3 wt % or more.

(4) If the amount of retained austenite is large, the seizure resistance of a sintered material is improved but the wear resistance deteriorates. In view of this, it is desirable to set the Ni content of the martensite parent phase to 5 wt % or less.

The effects of the increase of the V, Mo, Si and W contents of the parent phases in the material Nos. 6, 7, 8 and 9 were checked and the following facts were found.

(5) The increase of the amounts of the above elements leads to improved seizure resistance and wear resistance.

(6) Above all, the improvement obtained by the increased amount of Si in the material No. 8 was found to be more economical.

(7) The material Nos. 7 and 9 were produced by lowering sintering temperature to 1000° C. to restrict the temper softening resistance of Mo and W. As a result, these materials had slightly lower wear resistance.

The material Nos. 10 to 13 were prepared for the purpose of checking Al addition. Similarly to the case of the material No. 8, the following facts were found.

(8) Remarkably improved seizure resistance can be achieved by increasing the amount of Al or increasing the amounts of Al and Si.

(9) Remarkably improved seizure resistance can be economically achieved by a high concentration of Al.

Nos. 14 to 19 are materials in which 10% by volume or more $M_6C$-type carbide is dispersed.

(10) Compared to the material No. 7, the seizure resistance of the material Nos. 14 to 19 is significantly improved.

(11) Improved seizure resistance and wear resistance can be more economically achieved by increasing the Si content of a parent phase. It is understood from the comparison between the comparative material $FC_9CR_6Mo$ and the SKH9 that the amount of $M_6C$-type carbide is preferably 10% by volume and the total amount of the carbides is preferably 20 to 50% by volume, from the standpoint of the compositions and amounts of the carbides discussed in the column (1). However, in view of the effect of the carbides on the seizure resistance and wear resistance of a wear-resistant iron-based sintered contact material and the economical efficiency of alloy addition, the total amount of carbides is more preferably 25 to 45% by volume.

EXAMPLE 4

Composite Components and Producing Method

Where a conventional mixed powder containing 1 wt % of an organic lubricant is compacted under a compacting pressure of 3.5 ton/cm$^2$ or less with the method of making a floating seal test specimen (FIGS. 5(*a*), 5(*b*)) according to Example 3, handling of the compact is difficult due in part to the high hardness of the raw iron alloy powder. Therefore, a compacting pressure of 5 to 6 ton/cm$^2$ or less is necessary. When sinter-bonding was performed in the same condition as in Example 3, it was found that after bonding the inner circumferential surface of the compact to a backing metal (base material), the outer periphery of the bottom face of the compact warped upwardly without adhering to the backing metal. Therefore, the relationship between the height (i.e., the height of the ingate, see FIG. 5(*a*)) of the backing metal bonded to the inner circumferential surface of the sintered material and the thickness (2 mm) of the compact was firstly surveyed in this example. It was found from the survey that as the height of the ingate decreases to a value that is half the thickness of the compact or lower and the compacting pressure applied to the compact increases (i.e., the density of the compact becomes higher), the phenomenon in which the compact upwardly warps or climbs over the ingate more frequently occurs. This phenomenon is thought to be attributable to a great contractive force generated at the time of sinter-bonding. In this example, the compacting pressure was set to 0.2 to 3.5 ton/cm$^2$ with the aim of reducing the contractive force generated at the time of sinter-bonding, and compaction was performed such that the compacting pressure was substantially evenly transmitted to the powder material and the strength against handling was imparted to the resulting compact. More specifically, the compact was produced in the following way. An organic lubricant (microcrystalline wax) was added in an amount of 16 to 40% by volume to the raw mixed powder material of the wear-resistant iron-based sintered contact material and was blended at 100° C. using a high-speed mixer. Then, the mixed powder was granulated to produce particles having a diameter of 2 mm or less by use of a granulator equipped for the above mixer while cooling the mixed powder. The granulated powder was then compacted with the above-noted die, while ensuring fluidity. As a result, it was found that the amount of the organic lubricant is preferably 2.5 wt % or more in view of the easiness of handling the compact. If the amount of the organic lubricant exceeds 3.5 wt % or more, the porosity of the compact becomes approximately 0% under a compacting pressure of 2.5 t/cm$^2$ or more. In this case, the gaps among the metal particles are completely filled with the organic lubricant, which give rise to a possibility that the compact may be foamed in the process of degreasing during sintering. For this reason, it is understood that the amount of the organic lubricant is more preferably 2.5 to 5.0 wt % and the compacting pressure is more preferably 0.4 to 3.5 ton/cm$^2$.

Figure 7:
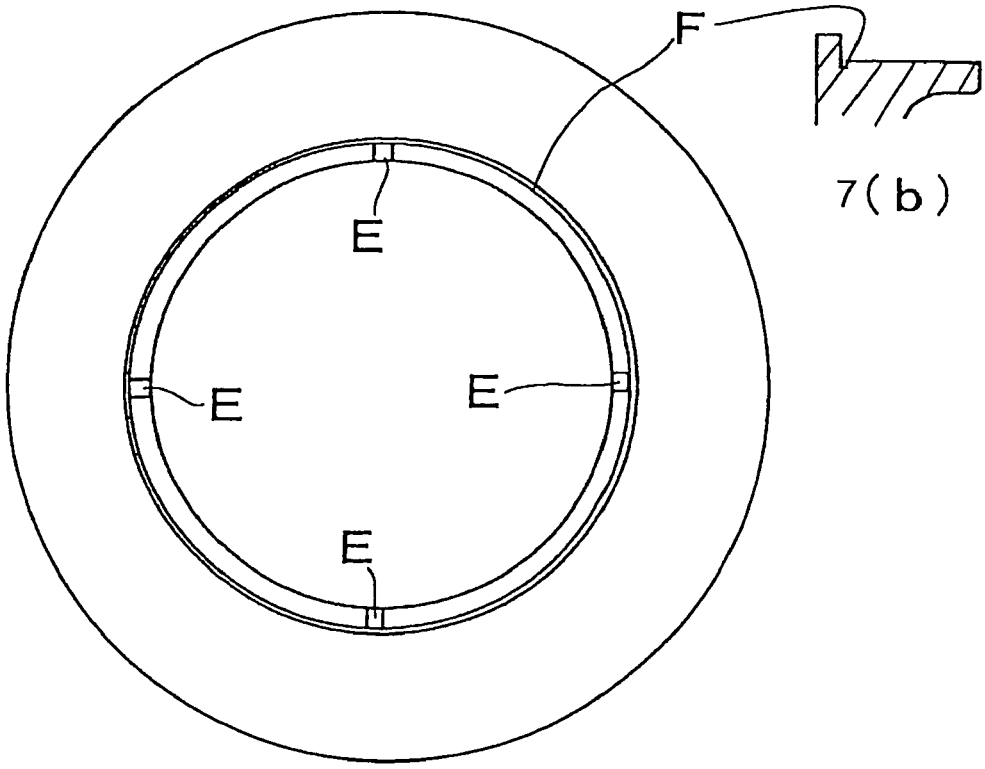
FIGS. 7(*a*) and 7(*b*) show notches for gas venting and a gas vent line provided for a backing metal member.

The compact produced under the above condition was used for forming the aforesaid floating seal. In this case, upward warping occurring during sinter-bonding of the compact could be perfectly prevented. After checking the bonding condition of the bonded surfaces of the floating seal with the ultrasonic wave detection method, it was found that an unbonded portion was likely to be formed on the bottom bonded surface of the compact on its inner circumferential surface side, on the ground that the gas generated during sinter-bonding was entrapped in this area. Therefore, this example was arranged such that the ingate of the backing metal which was to be joined to the inner circumferential surface of the wear-resistant iron-based sintered contact component was cut out to form four 1 mm-wide notches E for gas venting as shown in FIGS. 7(*a*) and 7(*b*). In addition, a gas vent line F having a depth of 0.5 mm was formed at the intersection of the ingate and the bottom surface. Thus, the problem of the above-described bonding defect was overcome by the provision of the notches E and the gas vent line F. Although the backing metal member is provided with the gas vent line and/or the gas vent notches (or gas vent holes) in the above description, it is apparent that the same function can be achieved by preliminarily forming the compact so as to have notches and/or grooves at its inner circumferential surface, its bottom surface, and/or the corners of the inner circumferential surface.

Figure 8:
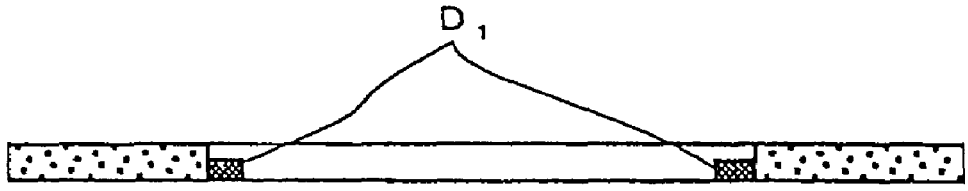
FIGS. 8(*a*) and 8(*b*) each shows a sectional view of a thrust washer at the inner circumferential surface of which is disposed a cylindrical backing metal.
Figure 8:
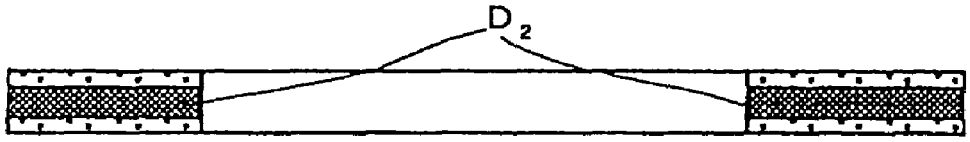
Figure 9:
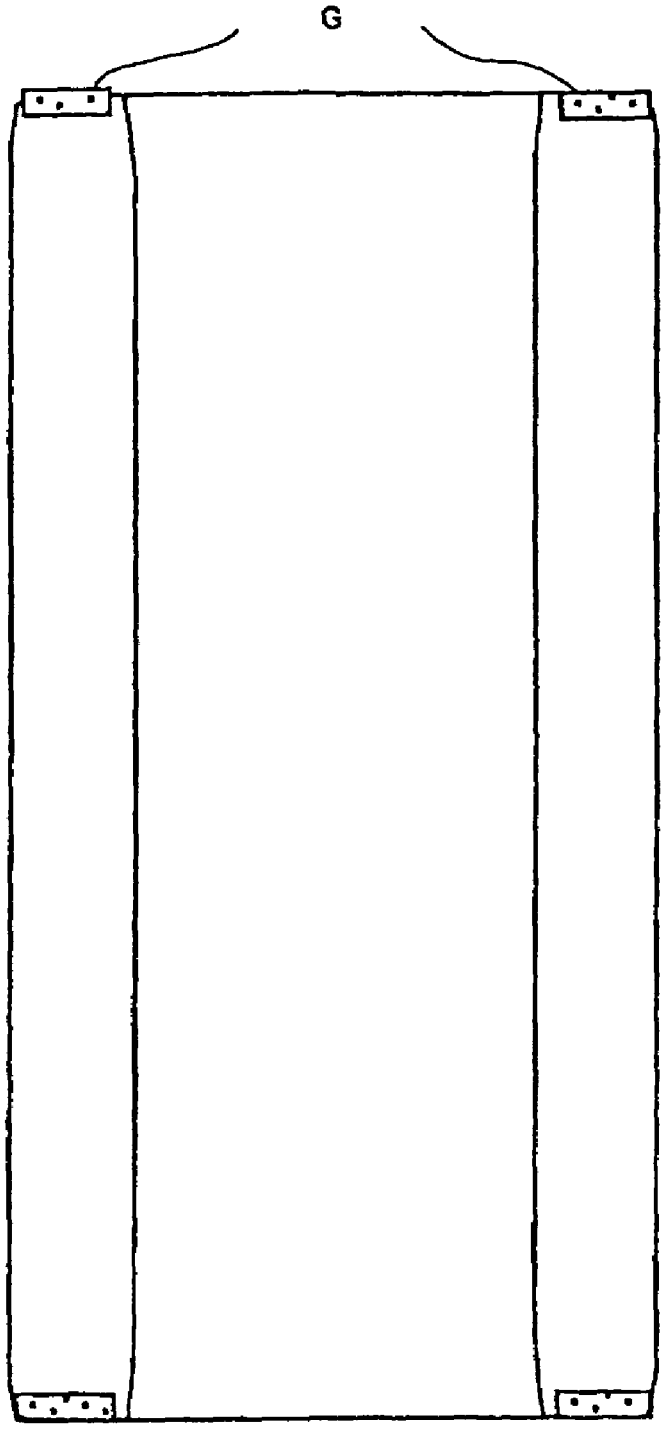
FIG. 9 is a sectional view of sintered joint members for use in the end faces of a crawler track bushing.

With the same concept as described above, a thrust washer having a thin-walled, cylindrical backing metal $D_1$ at the inner circumferential surface of the sintered compact can be made as shown in FIG. 8(*a*). Also, a thrust washer can be formed by sinter-bonding a backing metal $D_2$ or a backing metal $D_2$ in the form of a compact of the material of the wear-resistant iron-based sintered contact material, the backing metal $D_2$ being interposed in the wear-resistant iron-based sintered contact material as shown in FIG. 8(*b*). The compact of the sintered backing metal $D_2$ has a composition different from the composition of the wear-resistant iron-based sintered contact material and hardly changes in dimension at the sintering temperature for the wear-resistant iron-based sintered contact material. In another application, the wear-resistant iron-based sintered contact component G described in Example 3 is sinter-bonded to the end faces of a crawler track bushing as shown in FIG. 9. This enables the crawler track bushing to have excellent wear resistance at its end faces. Also, this technique is apparently applicable to thrust washers for use in a joint device of a work implement such as illustrated in FIGS. 10(*a*) to 10(*d*).

Figure 10:
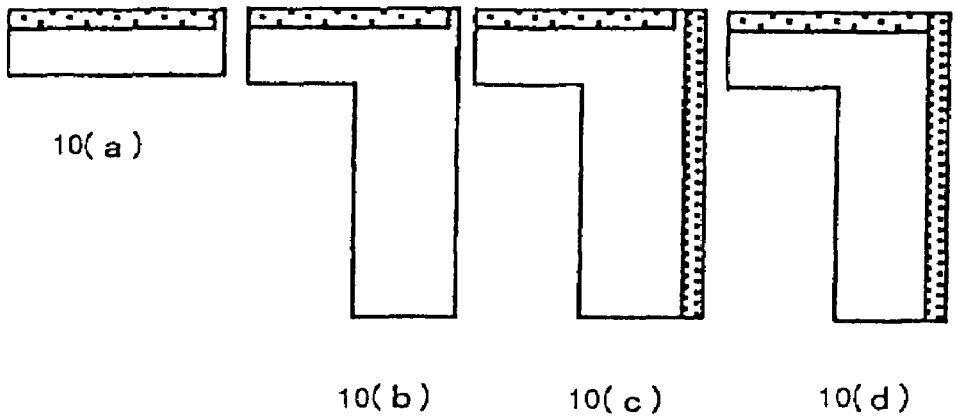
FIGS. 10(*a*) to 10(*d*) each shows a sectional view of a thrust washer for use in a work implement coupling system.

When producing the above-described wear-resistant iron-based sintered contact material containing Al, the compact markedly expands at the initial stage of sintering so that it can be sinter-bonded to the inner circumferential surface of a cylindrical backing metal as shown in FIGS. 10(*c*) and 10(*d*). This is disclosed in the prior application (Japanese Patent Application No. 2002-135275) filed by us. It is apparent that by combining with this technique, a thrust washer having improved wear resistance sliding properties in both the thrust and radial can be effectively produced. As a matter of course, it is possible to produce a thrust washer having a cylindrical backing metal D, in contact with the outer circumferential surface of the compact, in contrast with the thrust washer shown in FIG. 8(*a*) in which the thin-walled, cylindrical backing metal $D_1$ is in contact with the inner circumferential surface of the compact.

What is claimed is:

1. A wear-resistant sintered contact material wherein at least $Cr_7C_3$-type and/or $M_6C$-type carbides which have an average particle diameter of 5 μm or more are precipitately dispersed in an amount of 20 to 50% by volume within an iron-based martensite parent phase which has a hardness of HRC 50 or more even when tempered at up to 600° C., which is sinter-bonded to an iron-based backing metal having such a shape that the upper or lower surface and inner circumferential surface of the wear-resistant iron-based sintered contact material having a cylindrical disk shape can be bonded to the backing metal, and wherein one or more gas vent lines and/or gas vent holes are formed in the wear-resistant sintered contact material and/or the iron-based backing metal, and wherein after an organic lubricant is added in an amount of 2.5 to 5 wt % of the amount of a mixed powder to be sintered, the mixed powder is heat-blended at a temperature of 60 to 150° C. and granulated to form particles having a size of 2 mm or less, and these particles are mechanically pressed under a pressure of 0.4 to 3.5 ton/cm$^2$, forming a compact which is then sinter-bonded to an iron-based backing metal at 1100 to 1250° C. in an AX gas or vacuum atmosphere, followed by cooling and quenching.

2. The method of producing a wear-resistant sintered composite contact component made of wear-resistant sintered contact material according to claim 1, wherein the wear-resistant iron-based sintered composite contact component is formed by sinter-bonding to a backing metal having such a shape that the upper or lower surface and inner circumferential surface of the cylindrical disk shaped wear-resistant iron-based sintered contact material can be bonded to the backing metal, and wherein one or more gas vent lines and/or gas vent holes are formed in the wear-resistant sintered contact material and/or the iron-based backing metal.

3. A wear-resistant sintered composite contact component wherein a cylindrical disk shaped wear-resistant iron-based sintered contact material at least containing 1.0 to 3.7 wt % C and 3.5 to 18 wt % Cr is sinter-bonded to an iron backing metal, and wherein the outer or inner circumferential surface of the cylindrical iron-based backing metal is sinter-bonded to at least the inner or outer circumferential surface of the wear-resistant iron-based sintered contact material, and wherein after an organic lubricant is added in an amount of 2.5 to 5 wt % of the amount of a mixed powder to be sintered, the mixed powder is heat-blended at a temperature of 60 to 150° C. and granulated to form particles having a size of 2 mm or less, and these particles are mechanically pressed under a pressure of 0.4 to 3.5 ton/cm$^2$, forming a compact which is then sinter-bonded to an iron-based backing metal member at 1100 to 1250° C. in an AX gas or vacuum atmosphere, followed by cooling and quenching.

4. The method of producing the wear-resistant sintered composite contact component according to claim 3, wherein the wear-resistant iron-based sintered contact material is formed by sinter-bonding to the backing metal having such a shape that the upper or lower surface and inner circumferential surface of the cylindrical disk shaped wear-resistant iron-based sintered contact material can be bonded to the backing metal, and wherein one or more gas vent lines and/or gas vent holes are formed in the wear-resistant sintered contact material and/or the iron-based backing metal.

* * * * *